United States Patent [19]

Kato et al.

[11] Patent Number: 5,030,534

[45] Date of Patent: Jul. 9, 1991

[54] ELECTROPHOTOGRAPHIC PHOTORECEPTOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 395,008

[22] Filed: Aug. 17, 1989

[30] Foreign Application Priority Data

Aug. 18, 1988 [JP] Japan ..... 63-203933
Aug. 23, 1988 [JP] Japan ..... 63-207317
Sep. 6, 1988 [JP] Japan ..... 63-221486

[51] Int. Cl.[5] ..... G03G 5/00; C08F 18/16

[52] U.S. Cl. ..... 430/96; 430/127; 526/326

[58] Field of Search ..... 430/96

[56] References Cited

U.S. PATENT DOCUMENTS

| | | | |
|---|---|---|---|
| 3,885,961 | 5/1975 | Kimura et al. | 430/96 |
| 4,434,218 | 2/1984 | Tarumi et al. | 430/96 |
| 4,500,622 | 2/1985 | Horie et al. | 430/96 |
| 4,666,811 | 5/1987 | Bennett et al. | 430/74 |
| 4,871,638 | 10/1989 | Kato et al. | 430/96 |

*Primary Examiner*—Marion E. McCamish
*Assistant Examiner*—S. Crossan
*Attorney, Agent, or Firm*—Sughrue, Mion, Zinn, Macpeak & Seas

[57] ABSTRACT

An electrophotographic photoreceptor comprising a support having provided thereon at least one photoconductive layer containing an inorganic photoconductive material and a binder resin is disclosed, wherein the binder resin comprises (A) at least one resin having a weight average molecular weight of from $1\times10^3$ to $2\times10^4$ and containing from 0.1 to 20% by weight of a copolymerizable component containing at least one acidic group selected from the group consisting of wherein R represents a hydrocarbon group or —OR'; and R' represents a hydrocarbon group, and a cyclic acid anhydride-containing group, and (B) at least one copolymer resin comprising a monofunctional macromonomer having a weight average molecular weight of $2\times10^4$ or less, the macromonomer containing at least one polymerizable component represented by formula (B-2) or (B-3):

(B-2)

-continued (B-3)

wherein $X_0$ represents —COO—, —OCO—, —$CH_2$OCO—, —$CH_2$COO—, —O—, —$SO_2$—, —CO—, wherein $R_1$ represents a hydrogen atom or a hydrocarbon group; $Q_0$ represents an aliphatic group having from 1 to 18 carbon atoms or an aromatic group having from 6 to 12 carbon atoms; $b_1$ and $b_2$, which may be the same or different, each represents a hydrogen atom, a halogen atom, a cyano group, a hydrocarbon group, —COO—Z or —COO—Z bonded via a hydrocarbon group, wherein Z represents a hydrogen atom or a substituted or unsubstituted hydrocarbon group; and Q represents wherein Y represents a hydrogen atom, a halogen atom, an alkoxyl group or —COOZ', wherein Z' represents an alkyl group, an aralkyl group or an aryl group, with a polymerizable double bond-containing group represented by formula (B-1):

(B-1)

wherein V has the same meaning as $X_0$; and $a_a$ and $a_2$, which may be the same or different, each has the same meaning as $b_1$ and $b_2$, being bonded to only one of terminals of the main chain thereof, and a monomer represented by formula (B-4):

(B-4)

wherein $X_1$ has the same meaning as $X_0$; $Q_1$ has the same meaning as $Q_0$; and $c_1$ and $c_2$, which may be the same or different, each has the same meaning as $b_1$ and $b_2$. The photoreceptor exhibits excellent electrostatic characteristics, image formation performance as well as printing properties, irrespective of change in environmental condition or the kind of sensitizing dyes to be used in combination.

9 Claims, No Drawings

ELECTROPHOTOGRAPHIC PHOTORECEPTOR

FIELD OF THE INVENTION

This invention relates to an electrophotographic photoreceptor, and more particularly to an electrophotographic photoreceptor excellent in electrostatic characteristics and moisture resistance, and especially performance properties as a CPC photoreceptor.

BACKGROUND OF THE INVENTION

An electrophotographic photoreceptor may have various structures in agreement with prescribed characteristics or electrophotographic processes applied.

Widely employed among them is a system in which a photoreceptor comprises a support having provided thereon at least one photoconductive layer and, if necessary, an insulating layer on the surface thereof. The photoreceptor composed of a support and at least one photoconductive layer is subjected to ordinary electrophotographic processing for image formation including charging, imagewise exposure, development and, if necessary, transfer.

Electrophotographic photoreceptors have also been used widely as offset printing plate precursor for direct printing plate making. In particular, a direct electrophotographic lithographic printing system has recently been acquiring a greater importance as a system providing hundreds to thousands of prints of high image quality.

Binders to be used in the photoconductive layer should themselves have film-forming properties and capability of dispersing photoconductive particles therein, and, when formulated into a photoconductive layer, binders should exhibit satisfactory adhesion to a support. They are also required to bear various electrostatic characteristics and image-forming properties, such that the photoconductive layer may exhibit excellent electrostatic capacity, small dark decay and large light decay, hardly undergo fatigue before exposure, and stably maintain these characteristics against change of humidity at the time of image formation.

Binder resins which have been conventionally used include silicone resins (see JP-B-34-6670, the term "JP-B" as used herein means an "examined published Japanese patent application"), styrene-butadiene resins (see JP-B-35-1960), alkyd resins, maleic acid resins and polyamides (see Japanese JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510, and JP-B-41-13946), etc. However, electrophotographic photosensitive materials using these known resins suffer from any of disadvantages, such as poor affinity for photoconductive particles (poor dispersion of a photoconductive coating composition); low charging properties of the photoconductive layer; poor quality of a reproduced image, particularly dot reproducibility or resolving power; susceptibility of reproduced image quality to influences from the environment at the time of electrophotographic image formation, such as a high temperature and high-humidity condition or a low temperature and low humidity condition; and insufficient film strength or adhesion of the photoconductive layer, which causes, when used as an offset master plate, release of the photoconductive layer from the support during offset printing, failing to obtain a large number of prints.

In order to improve electrostatic characteristics of a photoconductive layer, various proposals have hitherto been made. For example, it has been proposed to incorporate into a photoconductive layer a compound containing an aromatic ring or furan ring containing a carboxyl group or nitro group either alone or in combination with a dicarboxylic acid anhydride as disclosed in JP-B-42-6878 and JP-B-45-3073. However, the thus improved photosensitive materials are still insufficient with regard to electrostatic characteristics, particularly in light decay characteristics. The insufficient sensitivity of these photosensitive materials has been compensated by incorporating a large quantity of a sensitizing dye into the photoconductive layer. However, photosensitive materials containing a large quantity of a sensitizing dye suffer considerable deterioration of whiteness, which means reduced quality as a recording medium, sometimes causing deterioration of dark decay characteristics, resulting in the failure to obtain a satisfactory reproduced image.

On the other hand, JP-A-60-10254 (the term "JP-A" as used herein means an "unexamined published Japanese patent application") suggests to control an average molecular weight of a resin to be used as a binder of the photoconductive layer. According to this suggestion, a combined use of an acrylic resin having an acid value of from 4 to 50 whose average molecular weight is distributed within two ranges, i.e., a range of from $1\times10^3$ to $1\times10^4$ and a range of from $1\times10^4$ and $2\times10^5$, would improve electrostatic characteristics, particularly reproducibility as a PPC photoreceptor on repeated use, moisture resistance and the like.

In the field of lithographic printing plate precursors, extensive studies have been conducted to provide binder resins for a photoconductive layer having electrostatic characteristics compatible with printing characteristics. Examples of binder resins so far reported to be effective for oil-desensitization of a photoconductive layer include a resin having a molecular weight of from $1.8\times10^4$ to $10\times10^4$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit having a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; a terpolymer containing a (meth)acrylic ester unit having an alkyl group having from 6 to 12 carbon atoms as a substituent and a vinyl monomer containing a carboxyl group as disclosed in JP-A-58-68046; and the like.

Nevertheless, actual evaluations of the abovedescribed resins proposed for improving electrostatic characteristics, moisture resistance and durability revealed that one of them was satisfactory for practical use in charging properties, dark charge retention, photosensitivity, and surface smoothness of a photoconductive layer.

The binder resins proposed for use in electrophotographic lithographic printing plate precursors were also proved by evaluations to give rise to problems relating to electrostatic characteristics and background staining of prints.

SUMMARY OF THE INVENTION

One object of this invention is to provide an electrophotographic photoreceptor having improved electrostatic characteristics, particularly dark charge retention and photosensitivity, and improved image reproducibility.

Another object of this invention is to provide an electrophotographic photoreceptor which can form a reproduced image of high quality irrespective of a variation of environmental conditions at the time of reproduction of an image, such as a change to a low-temperature and low-humidity condition or to a high-temperature and high-humidity condition.

A further object of this invention is to provide a CPC electrophotographic photoreceptor having excellent electrostatic characteristics and small dependence on the environment.

A still further object of this invention is to provide a lithographic printing plate precursor which provides a lithographic printing plate causing no background stains.

A yet further object of this invention is to provide an electrophotographic photoreceptor which is hardly influenced by the kind of sensitizing dyes used in combination.

It has now been found that the above objects of this invention can be accomplished by an electrophotographic photoreceptor comprising a support having provided thereon at least one photoconductive layer containing at least an inorganic photoconductive material and a binder resin, wherein the binder resin comprises (A) at least one resin having a weight average molecular weight of from $1\times10^3$ to $2\times10^4$ and containing from 0.1 to 20% by weight of a copolymerizable component containing at least one acidic group selected from $-PO_3H_2$, —COOH,

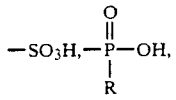

wherein R represents a hydrocarbon group or —OR'; and R' represents a hydrocarbon group, and a cyclic acid anhydride-containing group, and (B) at least one copolymer resin comprising a monofunctional macromonomer having a weight average molecular weight of $2\times10^4$ or less, the macromonomer containing at least one polymerizable component represented by formula (B-2) or (B-3):

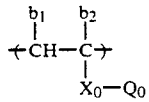

(B-2)

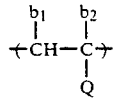

(B-3)

wherein $X_0$ represents —COO—, —OCO—, —$CH_2$OCO—, —$CH_2$COO—, —O—, —$SO_2$—, —CO—,

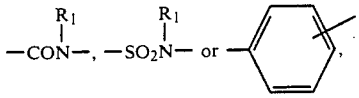

wherein $R_1$ represents a hydrogen atom or a hydrocarbon group; $Q_0$ represents an aliphatic group having from 1 to 18 carbon atoms or an aromatic group having from 6 to 12 carbon atoms; $b_1$ and $b_2$, which may be the same or different, each represents a hydrogen atom, a halogen atom, a cyano group, a hydrocarbon group, —COO—Z or —COO—Z bonded via a hydrocarbon group, wherein Z represents a hydrogen atom or a substituted or unsubstituted hydrocarbon group; and Q represents

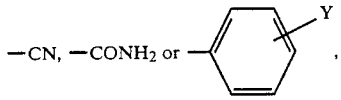

wherein Y represents a hydrogen atom, a halogen atom, an alkoxyl group or —COOZ', wherein Z' represents an alkyl group, an aralkyl group or an aryl group, with a polymerizable double bond-containing group represented by formula (B-1):

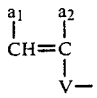

(B-1)

wherein V has the same meaning as $X_0$; and $a_1$ and $a_2$, which may be the same or different, each has the same meaning as $b_1$ and $b_2$, being bonded to only one of terminals of the main chain thereof, and a monomer represented by formula (B-4):

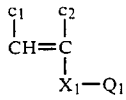

(B-4)

wherein $X_1$ has the same meaning as $X_0$; $Q_1$ has the same meaning as $Q_0$; and $c_1$ and $c_2$, which may be the same or different, each has the same meaning as $b_1$ and $b_2$.

DETAILED DESCRIPTION OF THE INVENTION

The binder resin which can be used in the present invention comprises at least (A) a low-molecular weight resin containing from 0.1 to 20% by weight, preferably from 1 to 10% by weight, of a copolymerizable component containing at least one of the above-recited acidic groups and (B) a copolymer resin comprising at least one macromonomer (M) and at least one monomer represented by formula (B-4).

The proportion of the acidic group-containing copolymerizable component in the resin (A) is from 0.1 to 20% by weight, preferably from 1.0 to 10% by weight. The resin (A) has a weight average molecular weight of from $1.0\times10^3$ to $2.0\times10^4$, preferably from $3\times10^3$ to $1.0\times10^4$. The resin (A) preferably has a glass transition point of from −10° to 100° C., more preferably from −5° to 85° C.

The resin (B) is preferably a comb type copolymer resin having a weight average molecular weight of $2\times10^4$ or more, more preferably from $5\times10^4$ to $6\times10^5$. The resin (B) preferably has a glass transition point of from 0° to 120° C., more preferably from 10° to 90° C.

In the present invention, the acidic group contained in the resin (A) is adsorbed onto stoichiometrical defects of an inorganic photoconductive substance to sufficiently cover the surface thereof, whereby electron traps of the photoconductive substance can be compensated for and humidity resistance can be greatly improved, while assisting the photoconductive particles to be sufficiently dispersed without agglomeration. The fact that the resin (A) has a low molecular weight also functions to improve covering power for the surface of the photoconductive particles. On the other hand, the resin (B) serves to sufficiently heighten the mechanical strength of a photoconductive layer, which may be insufficient in case of using the resin (A) alone.

If the content of the acidic group-containing copolymerizable component in the resin (A) is less than 0.1% by weight, the resulting electrophotographic photoreceptor has too a low initial potential to provide a sufficient image density. If it is more than 20% by weight, dispersing ability of the binder is reduced only to provide an electrophotographic photoreceptor suffering deterioration of film surface smoothness and humidity resistance. When used as an offset master, such a photoreceptor causes considerable background stains.

In general, if a photoreceptor to be used as a lithographic printing plate precursor is prepared from a non-uniform dispersion of photoconductive particles in a binder resin with agglomerates being present, the photoconductive layer would have a rough surface. As a result, non-image areas cannot be rendered uniformly hydrophilic by oil-desensitization treatment with an oil-desensitizing solution. Such being the case, the resulting printing plate induces adhesion of a printing ink to the non-image areas on printing, which phenomenon leads to background stains of the non-image areas of prints.

Even when only the low-molecular weight resin (A) of the present invention is used as a sole binder rein, it is sufficiently adsorbed onto the photoconductive particles to cover the surface of the particles to thereby provide smoothness of the photoconductive layer, satisfactory electrostatic characteristics, and stain-free images. Nevertheless, the resulting photoconductive layer does not exhibit sufficient film strength, failing to give satisfactory results in connection to durability.

In short, a proper adsorption-covering mutual action between the inorganic photoconductive particles and the binder resin and satisfactory film strength of a photoconductive layer can first be achieved only with a combined use of the resins (A) and (B).

In the acidic group

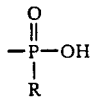

in the resin (A), R represents a hydrocarbon group or OR', wherein R' represents a hydrocarbon group. The hydrocarbon group as represented by R or R' specifically includes a substituted or unsubstituted alkyl group having from 1 to 12 carbon atoms (e.g., methyl, ethyl, propyl, butyl, hexyl, octyl, decyl, dodecyl, 2-chloroethyl, 2-methoxyethyl, 2-ethoxyethyl, and 3-methoxypropyl), a substituted or unsubstituted aralkyl group having from 7 to 12 carbon atoms (e.g., benzyl, phenethyl, chlorobenzyl, methoxybenzyl, and methylbenzyl), a substituted or unsubstituted alicyclic group having from 5 to 8 carbon atoms (e.g., cyclopentyl and cyclohexyl), and a substituted or unsubstituted aryl group (e.g., phenyl, tolyl, xylyl, mesityl, naphthyl, chlorophenyl, and methoxyphenyl).

Any of conventionally known resins can be used as the resin (A) as long as the above-stated requirements of physical properties are satisfied. Examples of such known resins include polyester resins, modified epoxy resins, silicone resins, olefin copolymers, polycarbonate resins, vinyl alkanoate resins, allyl alkanoate resins, modified polyamide resins, phenol resins, fatty acid-modified alkyd resins, and acrylic resins.

Preferred of the resin (A) is a (meth)acrylic copolymer containing at least one copolymerization component represented by the following formula (A-1) in a total proportion of at least 30% by weight:

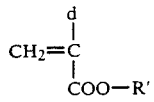

(A-1)

wherein d represents a hydrogen atom, a halogen atom (e.g., chlorine and bromine), a cyano group or an alkyl group having from 1 to 4 carbon atoms; and R' represents a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), a substituted or unsubstituted alkenyl group having from 2 to 18 carbon atoms (e.g., vinyl, allyl, isopropenyl, butenyl, hexenyl, heptenyl, and octenyl), a substituted or unsubstituted aralkyl group having from 7 to 12 carbon atoms (e.g., benzyl, phenethyl, naphthylmethyl, 2-naphthylethyl, methoxybenzyl, ethoxybenzyl, and methylbenzyl), a substituted or unsubstituted cycloalkyl group having from 5 to 8 carbon atoms (e.g., cyclopentyl, cyclohexyl, and cycloheptyl), or a substituted or unsubstituted aryl group (e.g., phenyl, tolyl, xylyl, mesityl, naphthyl, methoxyphenyl, ethoxyphenyl, chlorophenyl, and dichlorophenyl).

More preferred of the resin (A) is a resin comprising (i) at least one repeating unit represented by formula (A-2) or (A-3) shown below and (ii) at least one repeating unit containing an acidic group.

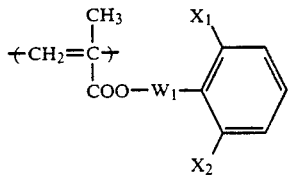

(A-2)

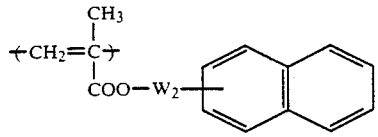

(A-3)

wherein $X_1$ and $X_2$ each represents a hydrogen atom, a hydrocarbon group having from 1 to 10 carbon atoms, a chlorine atom, a bromine atom, —$COY_1$ or $COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ and $W_2$ each represents a mere bond or a linking group containing from 1 to 4 linking atoms which connects —COO— and the benzene ring.

In formula (A-2), $X_1$ and $X_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), or —$COY_1$ or $COOY_2$, wherein $Y_1$ and $Y_2$ each preferably represents any of the above-recited hydrocarbon groups, provided that $X_1$ and $X_2$ do not simultaneously represent a hydrogen atom.

In formula (A-2), $W_1$ is a mere bond or a linking group containing 1 to 4 linking atoms, e.g., $-(CH_2)_n-$ (n: 1, 2 or 3), —$CH_2CH_2OCO$—, $-(CH_2)_m-$ (m: 1 or 2), and —$CH_2CH_2O$—, which connects —COO— and the benzene ring.

In formula (A-3), $W_2$ has the same meaning as $W_1$ of formula (A-2).

Specific examples of the repeating unit (i) represented by formula (A-2) or (A-3) are shown below for illustrative purposes only but not for limitation.

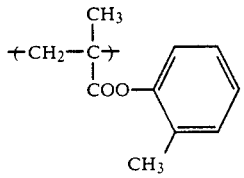
(i-1)

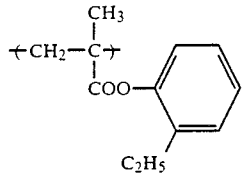
(i-2)

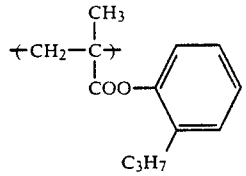
(i-3)

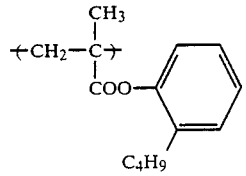
(i-4)

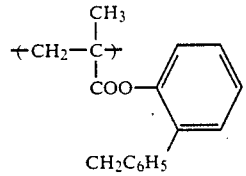
(i-5)

-continued

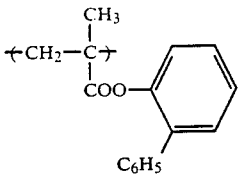
(i-6)

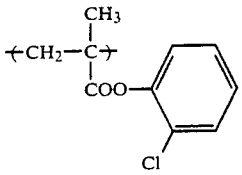
(i-7)

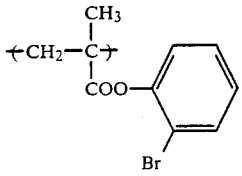
(i-8)

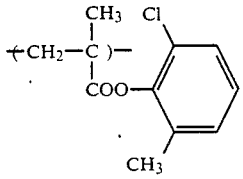
(i-9)

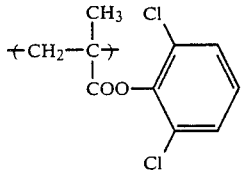
(i-10)

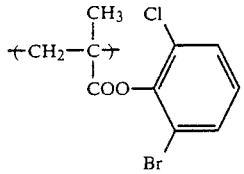
(i-11)

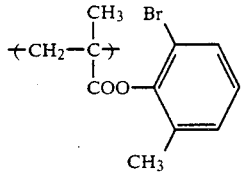
(i-12)

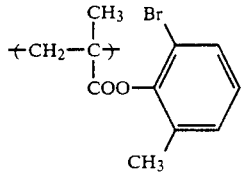
(i-13)

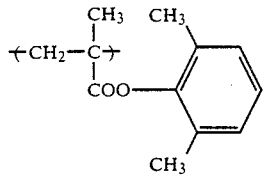
(i-14)

-continued
(i-15)
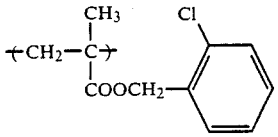
(i-16)
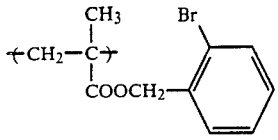
(i-17)
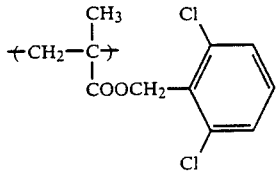
(i-18)
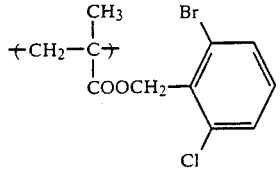
(i-19)
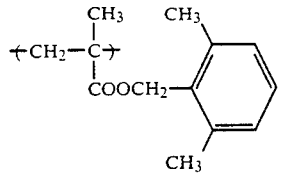
(i-20)
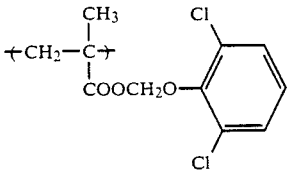
(i-21)
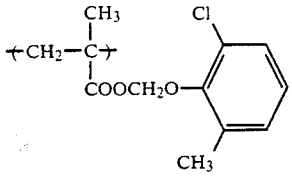
(i-22)
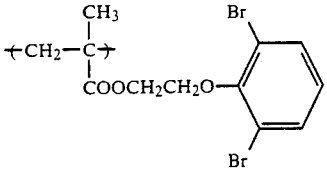
(i-23)
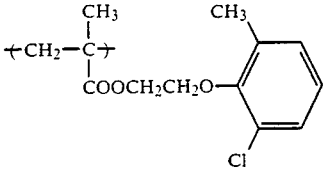
-continued
(i-24)
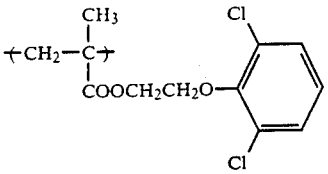
(i-25)
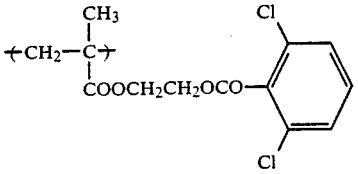
(i-26)
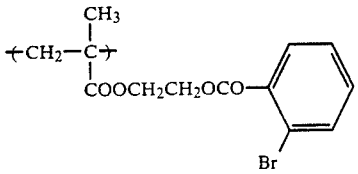
(i-27)
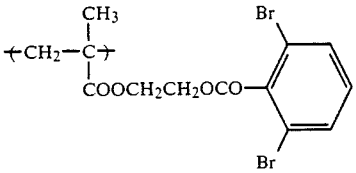
(i-28)
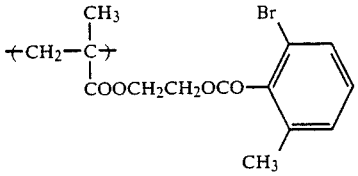
(i-29)
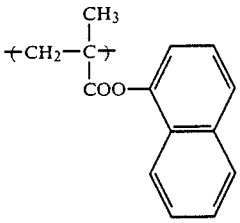
(i-30)
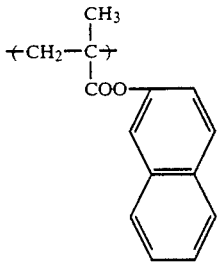
(i-31)
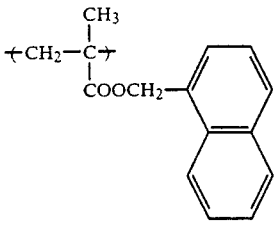

-continued (i-32)

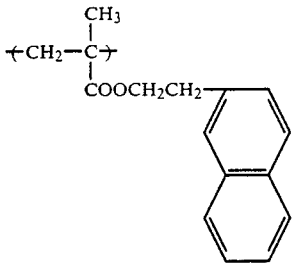

(i-33)

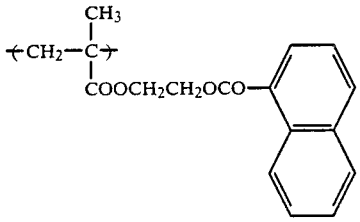

(i-34)

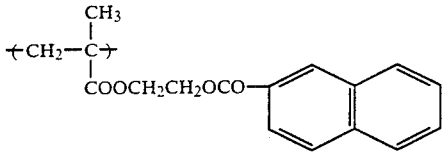

(i-35)

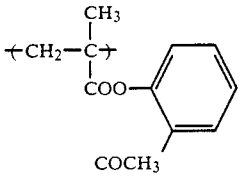

(i-36)

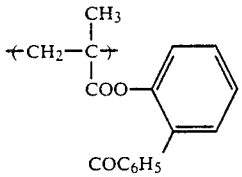

(i-37)

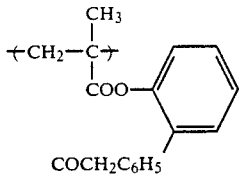

(i-38)

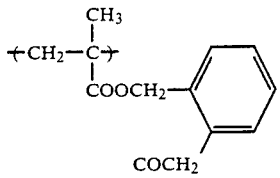

(i-39)

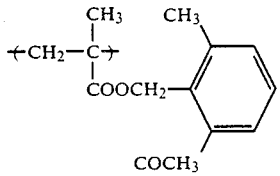

-continued (i-40)

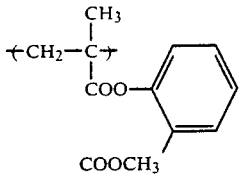

In the repeating unit (ii) containing the acidic group, the acidic group preferably includes $-PO_3H_2$, $-SO_3H$, $-COOH$,

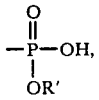

and a cyclic acid anhydride-containing group.

In the acidic group

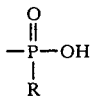

in the repeating unit (ii) of the resin (A), R represents a hydrocarbon group or OR′, wherein R′ represents a hydrocarbon group. The hydrocarbon group as represented by R or R′ preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 2-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes aliphatic dicarboxylic acid anhydrides and aromatic dicarboxylic acid anhydrides.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides are phthalic anhydride ring, naphthalenedicarboxylic acid anhydride ring, pyridinedicarboxylic acid anhydride ring, and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The copolymerizable component corresponding to the acidic group-containing repeating unit (ii) may be any of acidic group-containing vinyl compounds copolymerizable with a methacrylate monomer corresponding to the repeating unit (i) of formula (A-2) or (A-3). Examples of such vinyl compound are described, e.g., in Kobunshi Gakkai (ed.), *Kobunshi Data Handbook* (*Kosohen*), Baihukan (1986). Specific examples of these vinyl monomers are acrylic acid, α and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcareboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphoric acid, dicarboxylic acid vinyl or allyl half esters, and ester or amide derivatives of these carboxylic acids or sulfonic acids containing the polar group in the substituent thereof.

Specific examples of the acidic group-containing repeating unit (ii) is shown below for illustrative purposes only but no for limitation.

(ii-1)

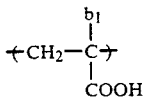

$b_1$:H, $CH_3$ (hereinafter the same)

(ii-2)

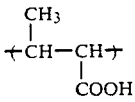

(ii-3)

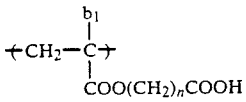

n: integer of 2 to 11

(ii-4)

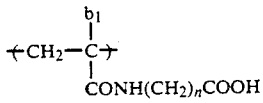

n: integer of 1 to 11

(ii-5)

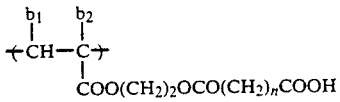

$b_2$:H, $CH_3$, $-CH_2COOCH_3$, (hereinafter the same)
n: integer of 1 to 3

(ii-6)

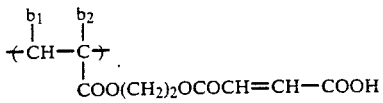

-continued (ii-7)

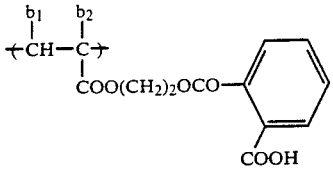

(ii-8)

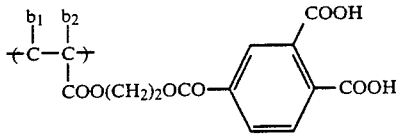

(ii-9)

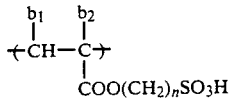

n: integer of 2 to 4

(ii-10)

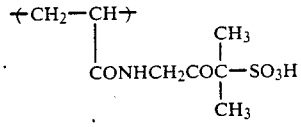

(ii-11)

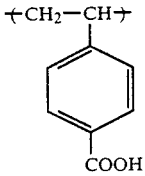

(ii-12)

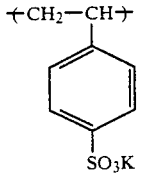

(ii-13)

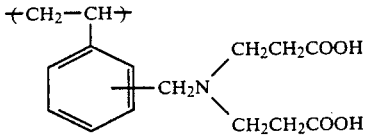

(ii-14)

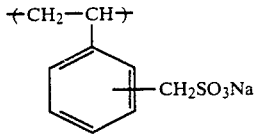

(ii-15)

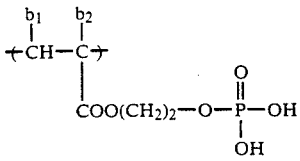

-continued (ii-16)

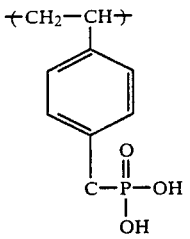

(ii-17)

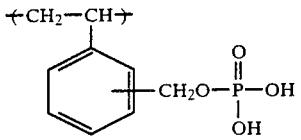

(ii-18)

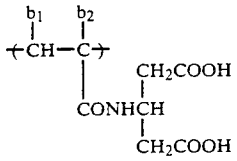

(ii-19)

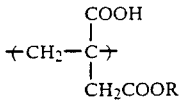

R: $C_1$—$C_4$ alkyl group (ii-20)

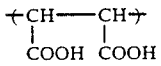

(ii-21)

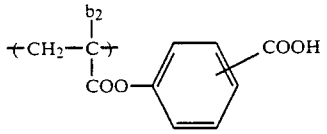

(ii-22)

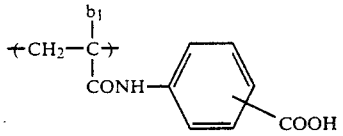

(ii-23)

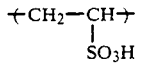

(ii-24)

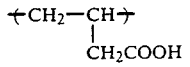

(ii-25)

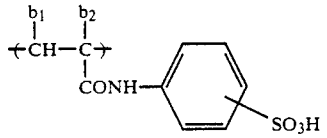

(ii-26)

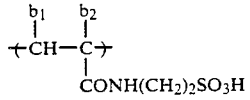

-continued (ii-27)

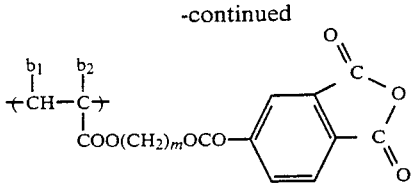

m: integer of 2 to 10

(ii-28)

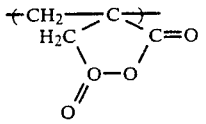

(ii-29)

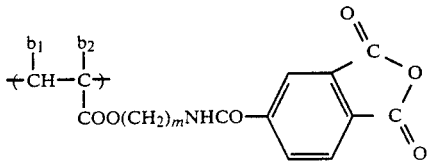

m: integer of 2 to 11

(ii-30)

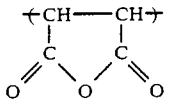

(ii-31)

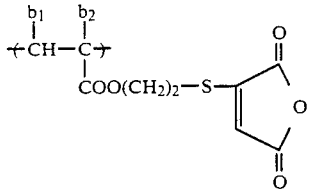

(ii-32)

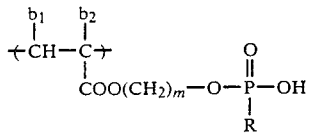

m: integer of 2 to 10;
R; $C_1$—$C_6$ alkyl, benzyl or phenyl

The acidic group-containing copolymerizable component which can be used in the resin (A) may be any of acidic group-containing vinyl compounds copolymerizable with, for example, a methacrylate monomer of formula (A-1). Examples of such vinyl compounds are described, e.g., in Kobunshi Gakkai (ed.), *Kobunshi Data Handbook* (*Kosohen*), Baihukan (1986). Specific examples of these vinyl monomers are acrylic acid, α-and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the polar group in the substituent thereof.

The resin (A) may further comprises other copolymerizable monomers in addition to the monomer of formula (A-1) and the acidic group-containing monomer. Examples of such monomers include α-olefins, vinyl alkanoates, allyl alkanoates, acrylonitrile, methacrylonitrile, vinyl ethers, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

The resin (B) which can be used in the present invention is a comb type copolymer resin having the above-described physical properties and comprising at least a monofunctional macromonomer (M) and the monomer represented by formula (B-4).

The resin (B) preferably has a weight average molecular weight of not less than $2\times10^4$, more preferably of from $5\times10^4$ to $6\times10^5$. The resin (B) preferably has a glass transition point ranging from 0° to 120° C., more preferably from 10° to 90° C.

The monofunctional monomer (M) is a polymer having a weight average molecular weight of not more than $2\times10^4$ which comprises at least one polymerization component represented by formula (B-2) or (B-3), with a polymerizable double bond-containing group represented by formula (B-1) being bonded to only one of the terminals of the main chain thereof.

In formulae (B-1), (B-2), and (B-3), the hydrocarbon groups as represented by $a_1$, $a_2$, V, $b_1$, $b_2$, $X_0$, $Q_0$, and Q, which contain the respectively recited number of carbon atoms when unsubstituted, may have a substituent.

In formula (B-1), V represents —COO—, —OCO—, —$CH_2$OCO—, —$CH_2$COO—, —O—, —$SO_2$—, —CO—,

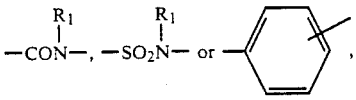

wherein $R_1$ represents or a hydrocarbon group. Preferred hydrocarbon groups as $R_1$ include a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atoms (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and doecyloylamidophenyl).

When V represents

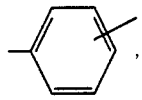

the benzene ring may have a substituent, such as a halogen atom (e.g., chlorine and bromine), an alkyl group (e.g., methyl, ethyl, propyl, butyl, chloromethyl, and methoxymethyl), and an alkoxy group(e.g., methoxy, ethoxy, propoxy, and butoxy).

$a_1$ and $a_2$, which may be the same or different, each preferably represents a hydrogen atom, a halogen atom (e.g., chlorine and fluorine), a cyano group, an alkyl group having from 1 to 4 carbon atoms (e.g., methyl, ethyl, propyl and butyl), or —COO—Z or —COO—Z bonded via a hydrocarbon group, wherein Z represents a hydrogen atom or an alkyl, alkenyl, aralkyl, alicyclic or aryl group having up to 18 carbon atoms, each of which may be substituted. More specifically, the examples of the hydrocarbon groups as enumerated for R; are applicable to Z. The hydrocarbon group via which —COO—Z is bonded includes a methylene group, an ethylene group, and a propylene group.

More preferably, in formula (B-1), V represents —COO—, —OCO—, —$CH_2$OCO—, —$CH_2$COO—, —O—, —CONH—, —$SO_2$HN— or

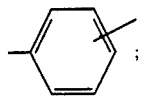

and $a_1$ and $a_2$, which may be the same or different, each represents a hydrogen atom, a methyl group, —COOZ, or —$CH_2$COOZ, wherein Z represents a hydrogen atom or an alkyl group having from 1 to 6 carbon atoms (e.g., methyl, ethyl, propyl, butyl, and hexyl). Most preferably, either one of $a_1$ and $a_2$ represents a hydrogen atom.

Specific examples of the polymerizable double bond-containing group represented by formula (B-1) are

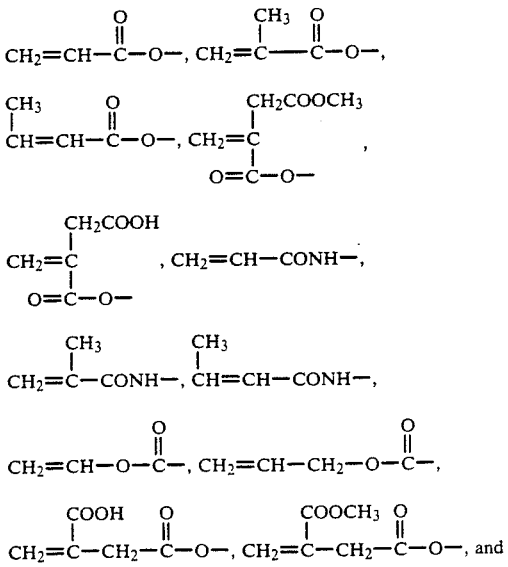

-continued

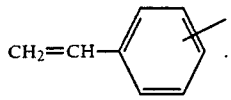

In formula (B-2), $X_0$ has the same meaning as V in formula (B-1); $b_1$ and $b_2$, which may be the same or different, each has the same meaning as $a_1$ and $a_2$ in formula (B-1); and $Q_0$ represents an aliphatic group having from 1 to 18 carbon atoms or an aromatic group having from 6 to 12 carbon atoms. Examples of the aliphatic group for $Q_0$ include a substituted or unsubstituted alkyl group having from 1 to 18 carbon atoms (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloro-propyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms (e.g., cycloheptyl, cyclohexyl, and cyclooctyl), and a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Examples of the aromatic group for $Q_0$ include a substituted or unsubstituted aryl group having from 6 to 12 carbon atoms (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (B-2), $X_0$ preferably represents —COO—, —O665 CO—, —$CH_2$COO—, —$CH_2$OCO—, —O—, —CO—, —CONH—, —$SO_2$NH—, or

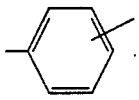

Preferred examples of $b_1$ and $b_2$ are the same as those described as preferred examples of $a_1$ and $a_2$.

In formula (B-3), Q represents —CN, —$CONH_2$, or

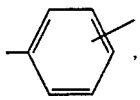

wherein Y represents a hydrogen atom, a halogen atom (e.g., chlorine and bromine), an alkoxy group (e.g., methoxy and ethoxy), or —COOR', wherein R' preferably represents an alkyl group having from 1 to 8 carbon atoms, an aralkyl group having from 7 to 12 carbon atoms, or an aryl group.

The macromonomer (M) may contain two or more polymerization components represented by formula (B-2) or (B-3). In cases where $Q_0$ in formula (B-2) is an aliphatic group having from 6 to 12 carbon atoms, it is preferable that the proportion of such a polymerization component of (B-2) should not exceed 20% by weight based on the total polymerization component in the macromonomer (M). In cases where $X_0$ in formula (B-2) is —COO—, it is preferable that the proportion of such a polymerization component of (B-2) be present in a proportion of at least 30% by weight based on the total polymerization component in the macromonomer (M).

In addition to the polymerization components of formula (B-2) and/or (B-3), the macromonomer (M) may further contain other repeating units derived from copolymerizable monomers. Such monomers include acrylonitrile, methacrylonitrile, acrylamides, methacrylamides, styrene and its derivatives (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyridine, vinylimidazole, vinylpyrrolidone, vinylthiophene, vinylpyrazole, vinyldioxane, and vinyloxazine).

As illustrated above, the macromonomer (M) to be used in the present invention has a structure in which a polymerizable double bond-containing group represented by formula (B-1) is bonded to one of the terminals of a polymer main chain comprising the repeating unit of formula (B-2) and/or the repeating unit of formula (B-3) either directly or via an arbitrary linking group.

The linking group which may be present between the component of formula (B-1) and the component of (B-2) or (B-3) includes a carbon-carbon double bond (either single bond or double bond), a carbon-hetero atom bond (the hetero atom includes an oxygen atom, a sulfur atom, a nitrogen atom, and a silicon atom), a hetero atomhetero atom bond, and an arbitrary combination thereof.

Preferred of the above-described macromonomer (M) are those represented by formula (B-2') or (B-3'):

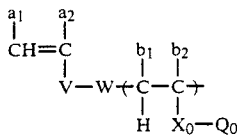

(B-2')

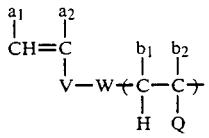

(B-3')

wherein $a_1$, $a_2$, $b_1$, $b_2$, V, $X_0$, $Q_0$, and Q are as defined above; W represents a mere bond or a linking group selected from

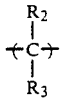

[wherein $R_2$ and $R_3$ each represents a hydrogen atom, a halogen atom (e.g., fluorine, chlorine, and bromine), a cyano group, a hydroxyl group, an alkyl group (e.g., methyl, ethyl, and propyl), etc.],

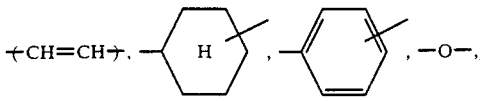

-continued

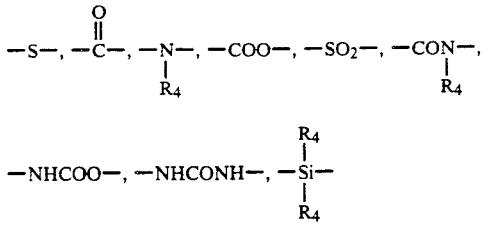

[wherein $R_4$ represents a hydrocarbon group having the same meaning as described for $Q_0$ of formula (B-2)], and an arbitrary combination thereof.

If the weight average molecular weight of the macromonomer (M) exceeds $2\times10^4$, copolymerizability with the monomer of formula (B-4) is reduced. If it is too small, the effect of improving electrophotographic characteristics of the photosensitive layer would be small. Accordingly, the macromonomer (M) preferably has a weight average molecular weight of at least $1\times10^3$.

The macromonomer (M) can be prepared by known methods, such as an ion polymerization process in which a various kind of a reagent is reacted on the terminal of a living polymer obtained by anion polymerization or cation polymerization to obtain a macromer; a radical polymerization process in which a various kind of a reagent is reacted with an oligomer terminated with a reactive group which is obtained by radical polymerization in the presence of a polymerization initiator and/or a chain transfer agent containing a reactive group (e.g., a carboxyl group, a hydroxyl group, and an amino group) in the molecule thereof thereby to obtain a macromer; or a polyaddition or polycondensation process in which a polymerizable double bond-containing group is introduced into an oligomer obtained by polyaddition or polycondensation in the same manner as in the above-described radical polymerization process.

For the details, reference can be made to it in P. Dreyfuss and R. P. Quirk, *Encycl. Polym. Sci. Eng.*, Vol. 7, p. 551 (1987), P. F. Rempp and E. Franta, Adu,. *Polym. Sci.*, Vol. 58, p. 1 (1984), V. Percec, Appl., *Polym. Sci.*, Vol. 285, p. 95 (1984), R. Asami and M. Takari, *Makvamol. Chem. Suppl.*, Vol. 12, p. 163 (1985), P. Rempp, et al., *Makvamol. Chem. Suppl.*, Vol. 8, p. 3 (1984), Yushi Kawakami, *Kagaku Sangyo*, Vol. 38, p. 56 (1987), Yuya Yamashita, *Kobunshi*, Vol. 30, .p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Shiro Toki and Takashi Tsuda, *Kino Zairyo*, Vol. 1987, No. 10, p. 5, and references cited in these literatures.

Specific examples of the macromonomer (M) which can be used in the present invention are shown below for illustrative purposes only but not for limitation.

(1)

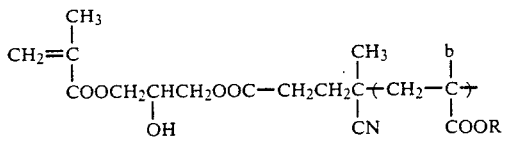

b = H, $CH_3$, or $-CH_2COOCH_3$

R = $-C_nH_{2n+1}$ (n: integer of 1 to 18), $CH_3$ $-CH_2C_6H_5$, $-C_6H_5$, or 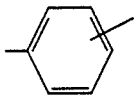

(2)

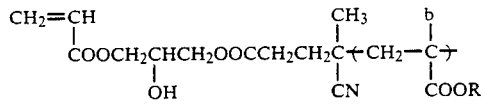

b = H, $CH_3$, or $-CH_2COOCH_3$

R = $-C_nH_{2n+1}$ (n: integer of 1 to 18), $-CH_2C_6H_5$, $-C_6H_5$, or 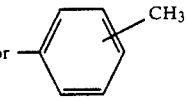

(3)

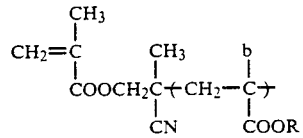

b = H, $CH_3$, R; $-C_nH_{2n+1}$ (n: integer of 1 to 18)

$-(CH_2)_m-C_6H_5$ (m: integer of 1 to 3)

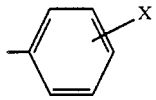

(X: $CH_3$, Cl, Br, $OCH_3$)

-continued
(4)
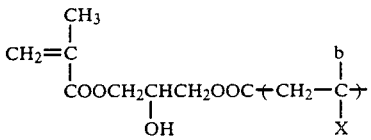
b = H, $CH_3$, X: $-COOCH_3$, $-C_6H_5$
(5)
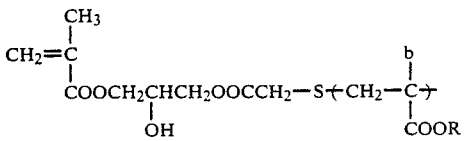
b = H or $CH_3$
R = $-C_nH_{2n+1}$ (n: integer of 1 to 18),
$-CH_2C_6H_5$, $-C_6H_5$, 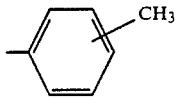
(6)
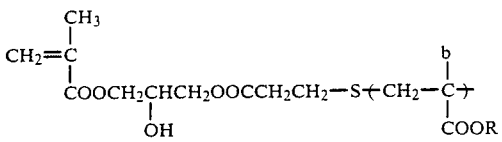
b = H, $CH_3$, or $-CH_2COOCH_3$
R = $-C_nH_{2n+1}$ (n: integer of 1 to 18),
$-CH_2C_6H_5$, $-C_6H_5$, 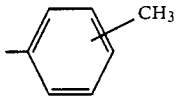
(7)
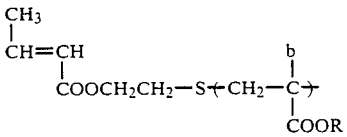
(8)
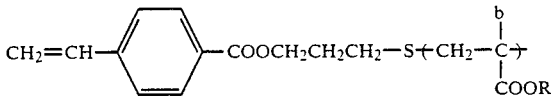
b = H, $-CH_3$
R = $-C_nH_{2n+1}$ (n: integer of 1 to 18),
$-CH_2C_6H_5$, $-C_6H_5$, 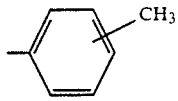
(9)
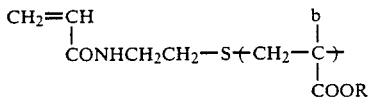
b = H, $-CH_3$
R = $-C_nH_{2n+1}$ (n: integer of 1 to 18),
$-CH_2C_6H_5$, $-C_6H_5$,
(10)
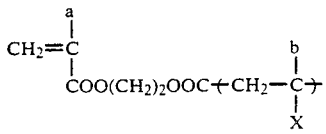
a = H, $CH_3$, b = H, $CH_3$
X = $-OC_nH_{2n+1}$ (n: integer of 1 to 18),
$-OCOC_mH_{2m+1}$ (m: integer of 1 to 18),
$-COOCH_3$, $-C_6H_5$, $-CN$ -continued (11)

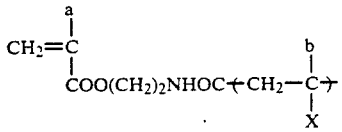

a = H, $CH_3$, b = H, $CH_3$,

X = $-COOCH_3$, $-C_6H_5$, 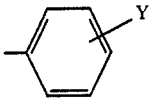 (Y = $-CH_3$, $-Cl$, $-Br$), $-Cl$ (12)

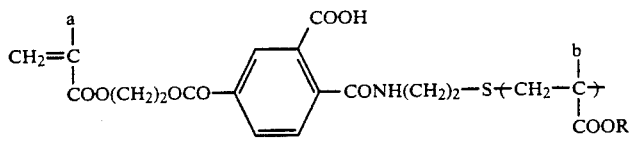

a = H, $CH_3$, b = H, $CH_3$,
R = $-C_nH_{2n+1}$ (n: integer of 1 to 18),
$-CH_2C_6H_5$, $-C_6H_5$ (13)

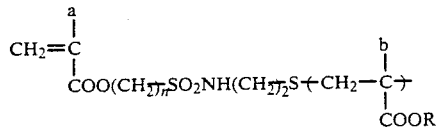

a = H, $CH_3$, b = H, $CH_3$, n = integer of 2 to 4,
R = $-C_nH_{2n+1}$ (n: integer of 1 to 18),
$-CH_2C_6H_5$, $-C_6H_5$ (14)

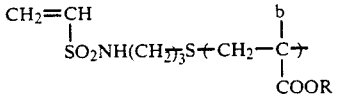

b = H, $CH_3$,
R = $-C_nH_{2n+1}$ (n: integer of 1 to 18),
$-CH_2C_6H_5$, $-C_6H_5$.

(15)

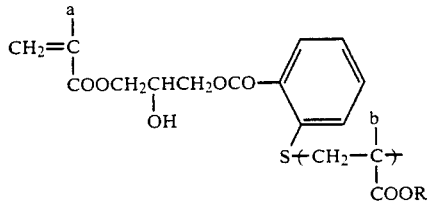

a = H, $CH_3$, b = Hm $CH_3$,
R = $-C_nH_{2n+1}$ (n: integer of 1 to 18),
$-CH_2C_6H_5$, $-C_6H_5$, (16)

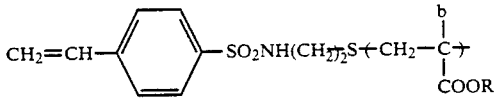

b = H, $CH_3$,
R = $-C_nH_{2n+1}$ (n: integer of 1 to 18),
$-CH_2C_6H_5$, $-C_6H_5$, (17)

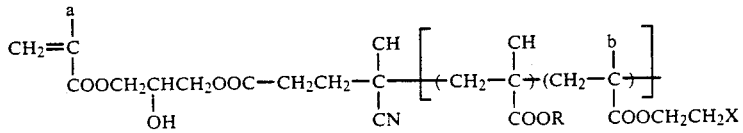

a = H, $CH_3$, b = H, $CH_3$
R = $-C_nH_{2n+1}$ (n: integer of 1 to 18),
$-CH_2C_6H_5$, $-C_6H_5$,
X = Cl, $-Br$, $-F$, $-OH$, $-CN$ -continued (18)

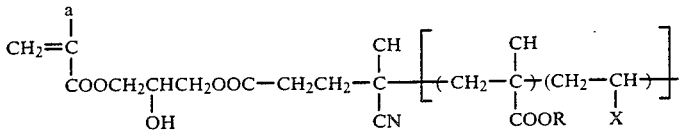

a = H, $CH_3$
X = $-OCOC_nH_{2n+1}$ (n: integer of 1 to 18),
$-CN$, $-CONH_2$, $-C_6H_5$,
R = $-C_nH_{2n+1}$ (n: integer of 1 to 18),
$-CH_2C_6H_5$ (19)

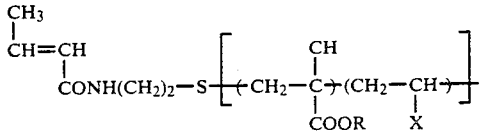

X = $-CN$, $-CONH_2$, $-C_6H_5$
R = $-C_nH_{2n+1}$ (n: integer of 1 to 18), $-CH_2C_6H_5$

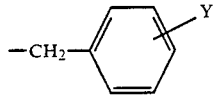

(Y = Cl, Br, $CH_3$, $-OCH_3$)

(20)

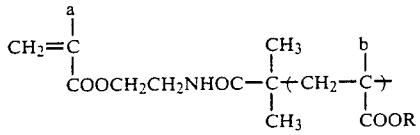

a = H, $CH_3$, b = H, $CH_3$, $-CH_2COOCH_3$
R = $-C_nH_{2n+1}$ (n: integer of 1 to 18),
$-CH_2C_6H_5$ (21)

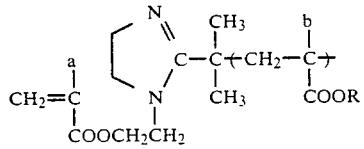

a = H, $CH_3$, b = H, $CH_3$, $-CH_2COOCH_3$,
R = $-C_nH_{2n+1}$ (n: integer of 1 to 18),
$-CH_2C_6H_5$ (22)

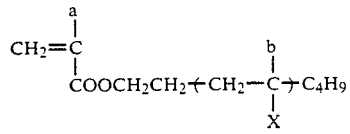

a = H, $CH_3$, b = H, $CH_3$,
X = $-COOCH_3$, $-C_6H_5$,

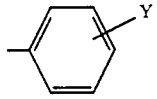

(Y=Cl, Br, $CH_3$, $-OCH_3$)

(23)

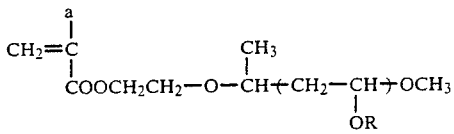

a = H, $CH_3$,
R = $-C_nH_{2n+1}$ (n: integer of 1 to 18), (24)

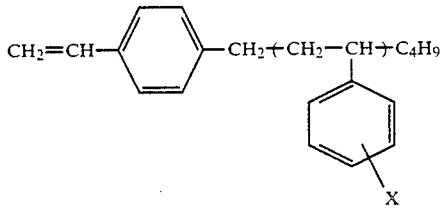

-continued

X = H, $CH_3$, Cl, Br, $OCH_3$, $-COOCH_3$

In formula (B-4) representing a monomer to be copolymerized with the macromer (M), $c_1$ and $c_2$, which may be the same or different, each has the same meaning as $a_1$ and $a_2$ in formula (B-1); $X_1$ has the same meaning as $X_0$ in formula (B-2); and $Q_1$ has the same meaning as $Q_0$ in fOrmula (B-2).

In addition to the macromer (M) and the monomer represented by formula (B-4), the resin (B) may further contain other copolymerizable monomers as copolymerization components. Included in the copolymerizable monomers are the acidic group-containing vinyl compounds as enumerated with respect to the resin (A) and, in addition, α-olefins, acrylonitrile, methacrylonitrile, acrylamide, methacrylamide, styrene, vinyl-containing naphthalene compounds (e.g., vinylnaphthalene and 1-isopropenylnaphthalene), and vinyl-containing heterocyclic compounds (e.g., vinylpyridine, vinylpyrrolidone, vinylthiophene, vinyltetrahydrofuran, vinyl-1,3-dioxoran, vinylimidazole, vinylthiazole, and vinyloxazoline).

In the resin (B), a copolymerization ratio of the macromer (M) to the monomer of formula (B-4) ranges 1 to 90/99 to 10, preferably 5 to 60/95 to 40, by weight.

In cases where the resin (B) contains a repeating unit derived from the acidic group-containing vinyl compound, it is preferably that the proportion of such a repeating unit does not exceed 10% by weight of the total copolymer. If it exceeds 10% by weight, the mutual action with inorganic photoconductive particles would become so marked that surface smoothness of the resulting photoreceptor is impaired, which results in deterioration of electrophotographic characteristics, particularly charging properties and dark decay retention.

Of the above-described resin (B), preferred is a resin (B') in which at least one acidic group selected from $-PO_3H_2$, $-SO_3H$, —COOH, and $-PO_3R''H$ (wherein R'' represents a hydrocarbon group; more specifically R'' has the same meaning as R) is bonded to only one terminal of the main chain of the polymer comprising at least one repeating unit derived from the macromonomer (M) and at least one repeating unit derived from the monomer of formula (B-4).

In this case, it is preferably that the polymer main chain does not contain a copolymerization component containing a polar group such as a carboxyl group, a sulfo group, a hydroxyl group, and a phosphono group.

The above-described acidic group may be bonded to one of the polymer main chain terminals either directly or via an arbitrary linking group.

The linking group for connecting the acidic group to the terminal is selected from a carbon-carbon bond (single bond or double bond), a carbon-hetero atom bond (the hetero atom includes an oxygen atom, a sulfur atom, a nitrogen atom, a silicon atom, etc.), a hetero atom-hetero atom bond, and an arbitrary combination thereof. Examples of the linking group are

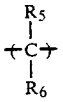

(wherein $R_5$ and $R_6$ each has the same meaning as $R_2$ and $R_3$),

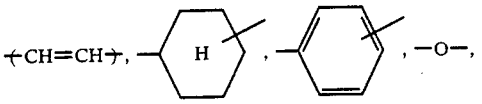

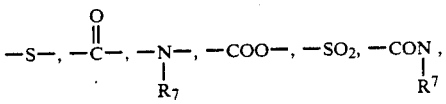

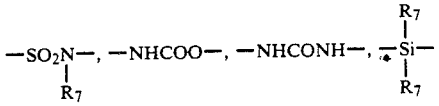

(wherein $R_7$ has the same meaning as $R_4$), and an arbitrary combination thereof.

In the resin (B'), the content of the acidic group bonded to one terminal of the polymer main chain preferably ranges from 0.1 to 15% by weight, more preferably from 0.5 to 10% by weight, based on the resin (B'). If it is less than 0.1% by weight, the effect of improving film strength would be small. If it exceeds 15% by weight, the photoconductive substance cannot be uniformly dispersed in the binder, forming an agglomerate, which results in the failure of forming a uniform coating film.

The resin (B') according to the present invention, in which the specific acidic group is bonded to only one terminal of the polymer main chain, can easily be prepared by an ion polymerization process in which a various kind of a reagent is reacted on the terminal of a living polymer obtained by conventionally known anion polymerization or cation polymerization; a radical polymerization process, in which radical polymerization is performed in the presence of a polymerization initiator and/or a chain transfer agent containing a specific acidic group in the molecule thereof; or a process, in which a polymer having a reactive group at the terminal thereof as obtained by the above-described ion polymerization or radical polymerization is subjected to high polymer reaction to convert the terminal to a specific acidic group.

For the details, reference can be made to it in P. Dreyfuss and R. P. Quirk, *Encycl. Polym. Sci. Eng.*, Vol. 7, p. 551 (1987), Yoshiki Nakajo and Yuya Yamashita *Senryo to Yakuhin,* Vol. 30, p. 232 (1985), Akira Ueda and Susumu Nagai, *Kagaku to Kogyo,* Vol. 60, p.57 (1986) and references cited therein.

The ratio of the resin (A) to the resin (B) [inclusive of the resin (B')] varies depending on the kind, particle size, and surface conditions of the inorganic photoconductive material used. In general, the weight ratio of the resin (A) to the resin (B) is 5 to 80:95 to 20, preferably 1 to 80.

The inorganic photoconductive material which can be used in the present invention includes zinc oxide, titanium oxide, zinc sulfide, cadmium sulfide, cadmium carbonate, zinc selenide, cadmium selenide, tellurium selenide, and lead sulfide.

The resin binder is used in a total amount of from 10 to 100 parts by weight, preferably from 15 to 50 parts by weight, per 100 parts by weight of the inorganic photoconductive material.

If desired, various dyes can be used as spectral sensitizer in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), phthalocyanine dyes (inclusive of metallized dyes), and the like. Reference can be made to it in Harumi Miyamoto and Hidehiko Takei, *Imaging*, Vol. 1973, No. 8, p. 12, C. J. Young, et al., *RCA Review*, Vol. 15, p. 469 (1954), Ko-hei Kiyota, et al., *Denkitsushin Gakkai Ronbunshi, J 63-C*, No. 2, p. 97 (1980), Yuji Harasaki, et al., *Kogyo Kagaku Zasshi*, Vol. 66, pp. 78 and 188 (1963), and Tadaaki Tani, *Nihon Shashin Gakkaishi*, Vol. 35, p. 208 (1972).

Specific examples of the carbonium dyes, triphenylmethane dyes, xanthene dyes, and phthalein dyes are described in JP-B-51-452, JP-A-50-90334, JP-A-50114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described in F. M. Harmmer, *The Cyanine Dyes and Related Compounds*. Specific examples are described in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, pp. 117 to 118 (1982).

The photoreceptor of the present invention is particularly excellent in that the performance properties are not liable to variation even when combined with various kinds of sensitizing dyes.

If desired, the photoconductive layer may further contain various additives commonly employed in the electrophotographic photoconductive layer, such as chemical sensitizers. Examples of the additives include electron-accepting compounds (e.g., halogen, benzoquinone, chloranil, acid anhydrides, and organic carboxylic acids) described in the above-cited *Imaging*, Vol. 1973, No. 8, p. 12; and polyarylalkane compounds, hindered phenol compounds, and p-phenylenediamine compounds described in Hiroshi Komon, et al., *Saikin-no Kododen Zairyo to Kankotai no Kaihatsu Jitsuyoka*, Chaps. 4 to 6, Nippon Kagaku Joho K. K. (1986).

The amount of these additives is not particularly critical and usually ranges from 0.0001 to 2.0 parts by weight per 100 parts by weight of the photoconductive substance.

The photoconductive layer of the photoreceptor suitably has a thickness of from 1 to 100 μm, particularly from 10 to 50 μm.

In cases where the photoconductive layer functions as a charge generating layer in a laminated photoreceptor composed of a charge generating layer and a charge transport layer, the thickness of the charge generating layer suitably ranges from 0.01 to 1 μm, particularly from 0.005 to 0.5 μm.

If desired, an insulating layer can be provided on the photoreceptor of the present invention. When the insulating layer is made to serve for the main purposes of protection and improvement of durability and dark decay characteristics, its thickness is relatively small. When the insulating layer is formed to provide a photoreceptor suitable for application to special electrophotographic processings, its thickness is relatively large, usually ranging from 5 to 70 μm, particularly from 10 to 50 μm.

Charge transport material in the above-described laminated photoreceptor include polyvinylcarbazole, oxazole dyes, pyrazoline dyes, and triphenylmethane dyes. The thickness of the charge transport layer ranges from 5 to 40 μm, preferably from 10 to 30 μm.

Resins to be used in the insulating layer or charge transport layer typically include thermoplastic and thermosetting resins, e.g., polystyrene resins, polyester resins, cellulose, resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic photosensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; the above-described base with the back side thereof (opposite to the photosensitive layer side) being rendered conductive and having further coated thereon at least one layer for the purpose of prevention of curling; the aforesaid supports having provided thereon a water-resistant adhesive layer; the aforesaid supports having provided thereon at least one precoat layer; and paper laminated with a plastic film on which aluminum, etc. is deposited.

Specific examples of conductive supports and materials for imparting conductivity are described in Yukio Sakamoto, *Denshishashin*, Vol. 14, No. 1, pp. 2 to 11 (1975), Hiroyuki Moriga, *Nyumon Tokushushi no Kagaku*, Kobunshi Kankokai (1975), and M. F. Hoover, *J. Macromol. Sci. Chem.*, A-4(6), pp. 1327 to 1417 (1970).

The present invention will now be illustrated in greater detail by way of Synthesis Examples, Examples and Comparative Examples, but it should be understood that the present invention is not deemed to be limited thereto.

SYNTHESIS EXAMPLE M-1

Synthesis of Macromonomer (M-1)

A mixed solution of 95 g of methyl methacrylate, 5 g of thioglycolic acid, and 200 g of toluene was heated to 75° C. in a nitrogen stream while stirring, and 1.0 g of 2,2'-azobis(cyanovaleric acid) (hereinafter abbreviated as ACV) was added thereto to effect polymerization for 8 hours. To the reaction solution were added 8 g of glycidyl methacrylate, 1.0 g of N,N-dimethyldodecylamine, and 0.5 g of t-butylhydroquinone, and the mixture was stirred at 100° C. for 12 hours. After cooling, the reaction solution was poured into 2 l of methanol to precipitate the polymer produced, which was collected to obtain 82 g of a white powder. The resulting polymer [designated as (M-1)] had a number average molecular weight (hereinafter referred to as Mn) of 6500.

SYNTHESIS EXAMPLE M-2

Synthesis of Macromonomer (M-2)

A mixed solution of 95 g of methyl methacrylate, 5 g of thioglycolic acid, and 200 g of toluene was heated to 70° C. in a nitrogen stream white stirring, and 1.5 g of 2,2'-azobis(isobutyronitrile) (hereinafter abbreviated as AIBN) was added thereto to effect reaction for 8 hours. Then, 7.5 g of glycidyl methacrylate, 1.0 g of N,N-dimethyldodecylamine, and 0.8 g of t-butylhydroquinone were added to the reaction solution, and the mixture was stirred at 100° C. for 12 hours. After cooling, the reaction solution was poured into 2 l of methanol to obtain 85 g of a colorless transparent viscous substance. The polymer (M-2) had an Mn of 2400.

SYNTHESIS EXAMPLE M-3

Synthesis of Macromonomer (M-3)

A mixed solution of 94 g of propyl methacrylate, 6 g of 2-mercaptoethanol, and 200 g of toluene was heated to 70° C. in a nitrogen stream, and 1.2 g of AIBN was added thereto to effect reaction for 8 hours. After the reaction solution was cooled to 20° C. in a water bath, 10.2 g of triethylamine was added thereto. To the mixture was further added dropwise 14.5 g of methacrylic acid chloride while stirring. After the dropwise addition, the stirring was continued for an additional one hour. Then, 0.5 g of t-butylhydroquinone was added thereto, followed by heating to 60° C. and stirring for 4 hours. After cooling, the reaction mixture was poured into 2 l of methanol to obtain 79 g of a colorless transparent viscous substance (M-3). The polymer (M-3) had an Mn of 4500.

SYNTHESIS EXAMPLE M-4

Synthesis of Macromonomer (M-4)

A mixed solution of 95 g of ethyl methacrylate and 200 g of toluene were heated to 70° C. in a nitrogen stream, and 5 g of 2,2'-azobis(cyanoheptanol) was added thereto to effect reaction for 8 hours. After cooling, the reaction mixture was cooled to 20° C. in a water bath, and 1.0 g of triethylamine and 21 g of methacrylic acid anhydride were added, followed by stirring for 1 hour and then at 60° C. for 6 hours.

After cooling, the reaction mixture was poured into 2 l of methanol to obtain 75 g of a colorless transparent viscous substance (M-4). The polymer (M-4) had an Mn of 6200.

SYNTHESIS EXAMPLE M-5

Synthesis of Macromonomer (M-5)

A mixture of 93 9 of benzyl methacrylate, 7 g of 3-mercaptopropionic acid, 170 g of toluene, and 30 g of isopropanol was heated to 70° C. in a nitrogen stream to prepare a uniform solution. To the solution was added 2.0 g of AIBN to effect reaction for 8 hours. After cooling, the reaction mixture was poured into 2 l of methanol and heated at 50° C. under reduced pressure to remove the solvent. The resulting viscous substance was dissolved in 200 g of toluene, and 16 g of glycidyl methacrylate, 1.0 g of N,N-dimethyldodecylmethacrylate, and 1.0 g of t-butylhydroquinone were added to the mixed solution, followed by stirring at 110° C. for 10 hours. The reaction solution was again poured into 2 l of methanol. The resulting pale yellow viscous substance (M-5) had an Mn of 3400.

SYNTHESIS EXAMPLE M-6

Synthesis of Macromonomer (M-6)

A mixed solution of 95 g of propyl methacrylate, 5 g of thioglycolic acid, and 200 g of toluene was heated to 70° C. in a nitrogen stream while stirring, and 1.0 g of AIBN was added thereto to effect reaction for 8 hours. Then, 13 g of glycidyl methacrylate, 1.0 g of N,N-dimethyldodecylamine, and 1.0 g of t-butylhydroquinone were added to the reaction solution, followed by stirring at 110° C. for 10 hours. After cooling, the reaction solution was poured into 2 l of methanol to obtain 86 g of a white powder. The resulting polymer (M-6) had an Mn of 3500.

SYNTHESIS EXAMPLE M-7

Synthesis of Macromonomer (M-7)

A mixture of 40 g of methyl methacrylate, 54 g of ethyl methacrylate, 6 g of 2-mercaptoethylamine, 150 g of toluene, and 50 g of tetrahydrofuran was heated to 75° C. in a nitrogen stream while stirring, and 2.0 g of AIBN was added thereto to effect reaction for 8 hours. The reaction solution was cooled to 20° C. in a water bath, and 23 g of methacrylic anhydride was added dropwise thereto taking care not to elevate the temperature above 25° C., followed by stirring for 1 hour. Then, 0.5 g of 2,2'-methylenebis(6-t-butyl-p-cresol) was added thereto, followed by stirring at 40° C. for 3 hours. After cooling, the reaction solution was poured into 2 l of methanol to obtain 83 g of a viscous substance (M-7). The resulting polymer (M-7) had an Mn of 2200.

SYNTHESIS EXAMPLE M-8

Synthesis of Macromonomer (M-8)

A mixed solution of methyl methacrylate, 150 g of toluene, and 150 g of ethanol was heated to 75° C. in a nitrogen stream, and 5 g of ACV was added thereto to effect reaction for 8 hours. Then, 15 g of glycidyl acrylate, 1.0 g of N,N-dimethyldodecylamine, and 1.0 g of 2.2'-methylenebis(6-t-butyl-p-cresol) were added to the reaction solution, followed by stirring at 100° C. for 15 hours. After cooling, the reaction mixture was poured into 2 l of methanol to obtain 83 g of a transparent viscous substance (M-8). The resulting polymer (M-8) had an Mn of 3600.

SYNTHESIS EXAMPLES M-9 to M-18

Synthesis of Macromonomers (M-9) to (M-18)

Macromonomers (M-9) to(M-18) were synthesized in the same manner as in Synthesis Example M-3, except for replacing methacrylic acid chloride with each of the acid halides shown in Table 1. The resulting macromonomers (M-9) to (M-18) had an Mn of from 4000 to 5000.

TABLE 1

| Synthesis Example No. | Macro-monomer | Acid Halide (Amount: g) | | Yield (g) |
|---|---|---|---|---|
| 9 | M-9 | $CH_2=CH-COCl$ | 13.5 | 75 |
| 10 | M-10 | $CH_3$<br>\|<br>$CH=CH-COCl$ | 14.5 | 80 |
| 11 | M-11 | 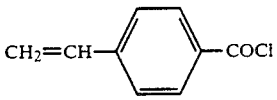 | 15.0 | 83 |
| 12 | M-12 | $CH_2=CH$<br>\|<br>$COO(CH_2)_2COCl$ | 15.5 | 73 |
| 13 | M-13 | $CH_3$<br>\|<br>$CH_2=C$<br>\|<br>$COO(CH_2)_2OCO(CH_2)_2COCl$ | 18.0 | 75 |
| 14 | M-14 | $CH_3$<br>\|<br>$CH_2=C$<br>\|<br>$CONH(CH_2)_4COCl$ | 18.0 | 80 |
| 15 | M-15 | 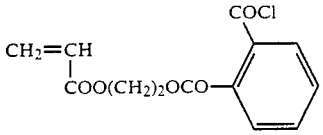 | 20.0 | 81 |
| 16 | M-16 | $CH_3$<br>\|<br>$CH_2=C$ Br<br>\| \|<br>$COOCH_2CHCH_2OCO(CH_2)_3COCl$ | 20.0 | 78 |
| 17 | M-17 | $CH_2=CH-CH_2$<br>\|<br>$OCO(CH_2)_2COCl$ | 16.0 | 72 |
| 18 | M-18 | $CH_2=C-COCl$<br>\|<br>$CH_2COOCH_3$ | 17.5 | 75 |

SYNTHESIS EXAMPLES M-19 TO M-27

Synthesis of Macromonomers (M-19) to (M-27)

Macromonomers (M-19) to (M-27) were synthesized in the same manner as in Synthesis Example M-2, except for replacing methyl methacrylate with each of the monomers shown in Table 2.

TABLE 2

| Synthesis Example No. | Macro-monomer | Monomer (Amount: g) | | Mn |
|---|---|---|---|---|
| 19 | M-19 | ethyl methacrylate | (95) | 2800 |
| 20 | M-20 | methyl methacrylate | (60) | 3200 |
| | | butyl methacrylate | (35) | |
| 21 | M-21 | butyl methacrylate | (85) | 3300 |
| | | 2-hydroxyethyl methacrylate | (10) | |
| 22 | M-22 | ethyl methacrylate | (75) | 2200 |
| | | styrene | | |
| 23 | M-23 | methylmethacrylate | (80) | 2500 |
| | | methyl acrylate | (15) | |
| 24 | M-24 | ethyl acrylate | (75) | 3000 |
| | | acrylonitrile | (20) | |
| 25 | M-25 | Propyl methacrylate | (87) | 2200 |
| | | N.N-dimethylaminoethyl methacrylate | (8) | |

TABLE 2-continued

| Synthesis Example No. | Macro-monomer | Monomer (Amount: g) | | Mn |
|---|---|---|---|---|
| 26 | M-26 | butyl methacrylate | (90) | 3100 |
| | | N-vinylpyrrolidone | (5) | |
| 27 | M-27 | methyl methacrylate | (89) | 3000 |
| | | dodecyl methacrylate | (6) | |

SYNTHESIS EXAMPLES M-28 TO M-32

Synthesis of Macromonomers (M-28) to (M-32)

Macromonomers (M-28) to (M-32) were synthesized in the same manner as in Synthesis Example M-2, except for replacing methyl methacrylate with each of the monomers of Table 3.

TABLE 3

| Synthesis Example No. | Macro-monomer | Monomer | Mn |
|---|---|---|---|
| 28 | M-28 | ethyl methacrylate | 2800 |
| 29 | M-29 | butyl methacrylate | 3000 |

TABLE 3-continued

| Synthesis Example No. | Macro-monomer | Monomer | Mn |
|---|---|---|---|
| 30 | M-30 | benzyl methacrylate | 3200 |
| 31 | M-31 | cyclohexyl methacrylate | 2900 |
| 32 | M-32 | phenyl methacrylate | 2500 |

SYNTHESIS EXAMPLE A-1

Synthesis of Resin (A-1)

A mixed solution of 95 g of 2,6-dichlorophenyl methacrylate, 5 g of acrylic acid, and 200 g of toluene was heated to 90° C. in a nitrogen stream, and 6 g of 2,2'-azobis(2,4-dimethylvaleronitrile) was added to effect reaction for 10 hours. The resulting copolymer (A-1) had a weight average molecular weight (hereinafter referred to Mw) of 7800.

SYNTHESIS EXAMPLES A-2 TO A-24

Synthesis of Resin (A-2) to (A-24)

Resins (A) shown in Table 4 below were synthesized under the same polymerization conditions as in Synthesis Example A-1. These resins had an Mw between 6000 and 8000.

TABLE 4

| Synthesis Example No. | Resin (A) | Composition of Resin (A) (weight ratio) |
|---|---|---|
| A-2 | [A]-2 | 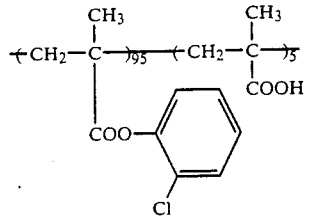 |
| A-3 | [A]-3 | 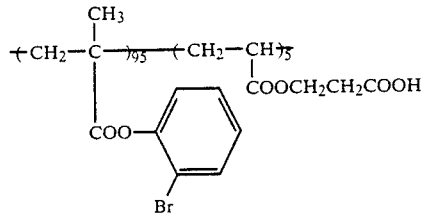 |
| A-4 | [A]-4 | 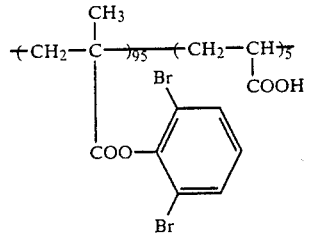 |
| A-5 | [A]-5 | 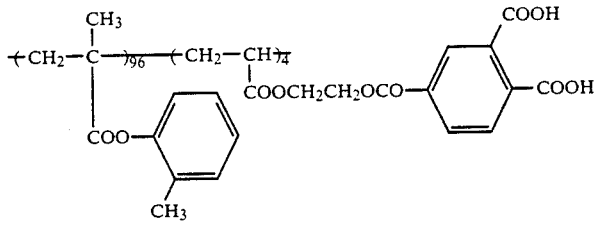 |
| A-6 | [A]-6 | 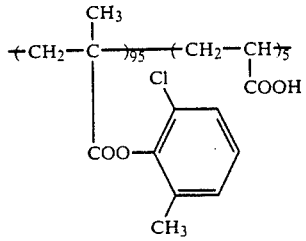 |

TABLE 4-continued
| Synthesis Example No. | Resin (A) | Composition of Resin (A) (weight ratio) |
|---|---|---|
| A-7 | [A]-7 | 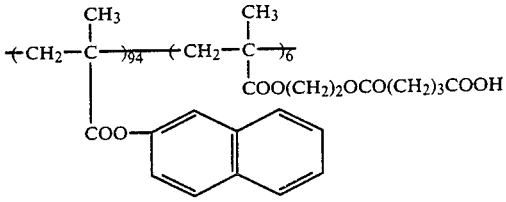 |
| A-8 | [A]-8 | 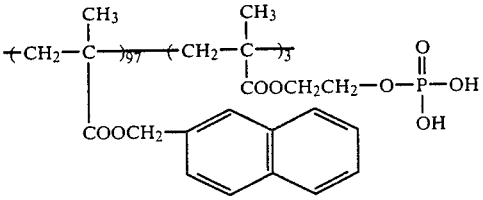 |
| A-9 | [A]-9 | 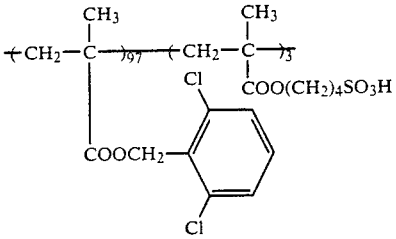 |
| A-10 | [A]-10 | 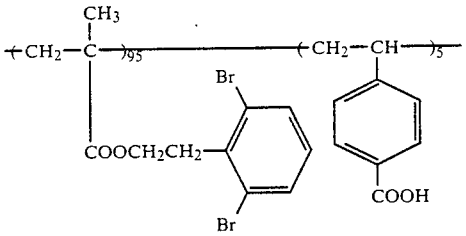 |
| A-11 | [A]-11 | 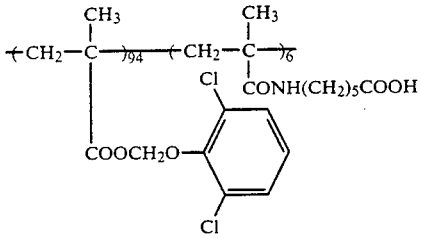 |
| A-12 | [A]-12 | 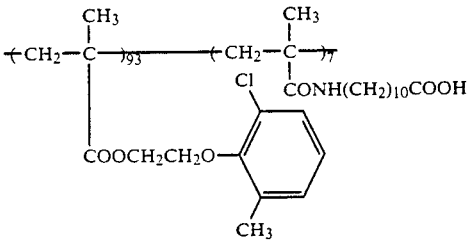 |

TABLE 4-continued
| Synthesis Example No. | Resin (A) | Composition of Resin (A) (weight ratio) |
|---|---|---|
| A-13 | [A]-13 | 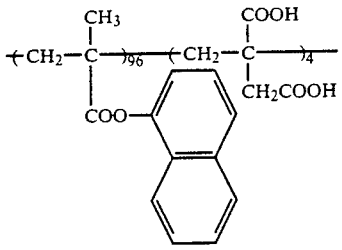 |
| A-14 | [A]-14 | 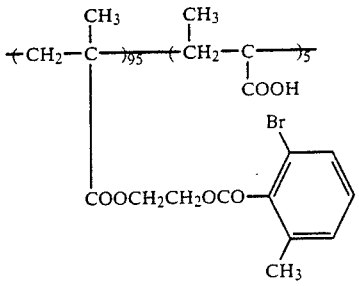 |
| A-15 | [A]-15 | 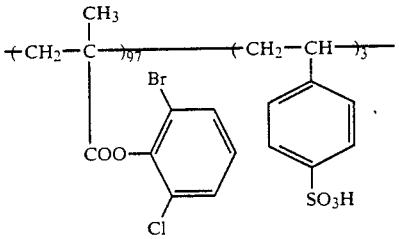 |
| A-16 | [A]-16 | 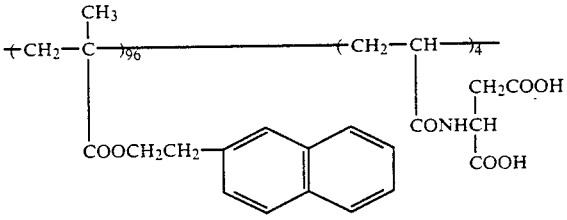 |
| A-17 | [A]-17 | 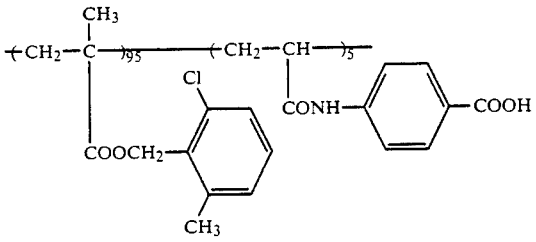 |
| A-18 | [A]-18 | 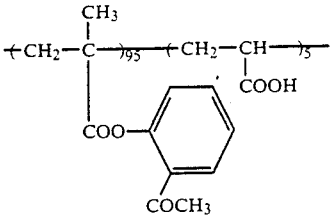 |

TABLE 4-continued

| Synthesis Example No. | Resin (A) | Composition of Resin (A) (weight ratio) |
|---|---|---|
| A-19 | [A]-19 | 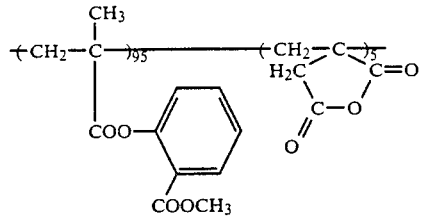 |
| A-20 | [A]-20 | 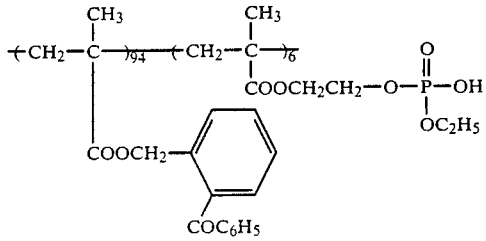 |
| A-21 | [A]-21 | 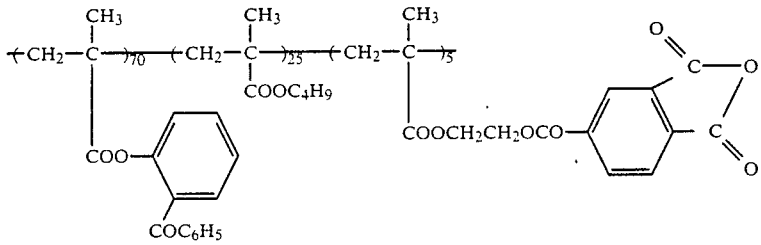 |
| A-22 | [A]-22 | 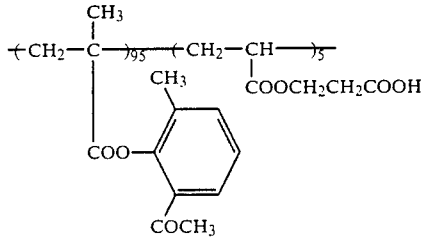 |
| A-23 | [A]-23 | 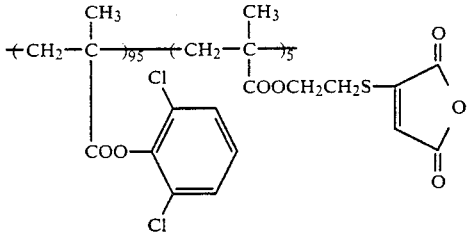 |
| A-24 | [A]-24 | 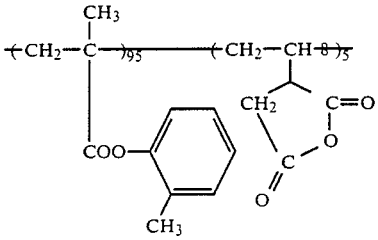 |

SYNTHESIS EXAMPLE A-25

Synthesis of Resin (A-25)

A mixed solution of 95 g of 2-chloro-6-methylphenyl methacrylate, 5 g of methacrylic acid, 3 g of n-dodecylmercaptan, and 200 g of toluene was heated to 70° C. in a nitrogen stream, and 1.5 g of 2,2'-azobis(isobutyronitrile) was added thereto to effect reaction for 4 hours. The resulting copolymer (A-25) had an Mw of 8500.

SYNTHESIS EXAMPLES A-26 TO A-30

Synthesis of Resins (A-26) to (A-30)

Resins (A) of Table 5 were synthesized under the same polymerization conditions as in Reference Example A-25. These resins had an Mw between 7000 and9000.

TABLE 5

| Synthesis Example No. | Resin (A) | Composition of Resin (A) (weight ratio) |
|---|---|---|
| A-26 | (A-26) | 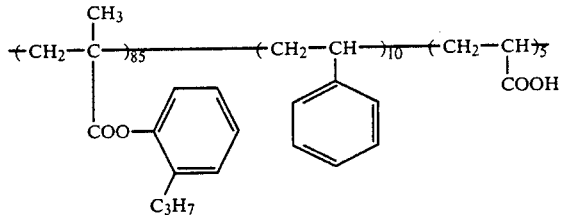 |
| A-27 | (A-27) | 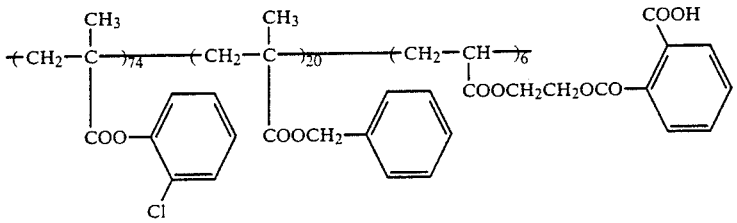 |
| A-28 | (A-28) | 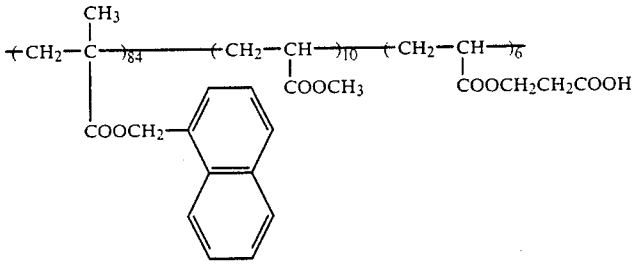 |
| A-29 | (A-29) | 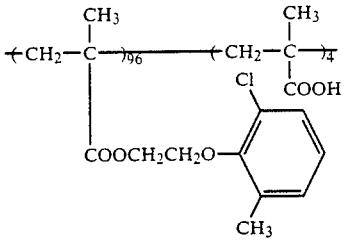 |
| A-30 | (A-30) | 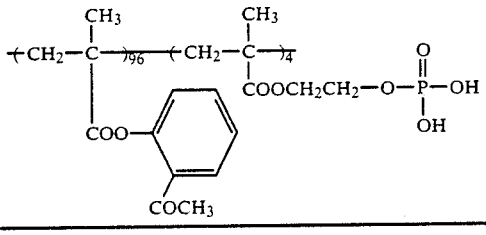 |

SYNTHESIS EXAMPLE A-31

Synthesis of Resin (A-31)

A mixed solution of 95 g of ethyl methacrylate, 5 g of acrylic acid, and 200 g of toluene were heated to 90° C. in a nitrogen stream, and 7 g of AIBN was added thereto to effect reaction for 8 hours. The resulting copolymer (A-31) had an Mw of 7400 and a glass transition point (hereinafter referred to as Tg) of 45° C.

SYNTHESIS EXAMPLE A-32

Synthesis of Resin (A-32)

A mixed solution of 94 g of benzyl methacrylate, 6 g of acrylic acid, 5.0 g of dodecylmercaptan, and 200 g of toluene was heated to 75° C. in a nitrogen stream, and 1.0 g of AIBN was added thereto to effect reaction for 8 hours. The resulting copolymer had an Mw of 6500 and a Tg of 49° C.

SYNTHESIS EXAMPLES A-33 TO A-40

Synthesis of Resins (A-33) to (A-40)

Resins A were synthesized in the same manner as in Synthesis Example A-31, except for replacing 95 g of ethyl methacrylate with each of the monomers or monomer mixture shown in Table 6.

TABLE 6

| Synthesis Example No. | Resin (A) | Monomer(s) (Amount: g) | | Mn |
|---|---|---|---|---|
| 33 | (A-33) | methyl methacrylate | (95) | 6800 |
| 34 | (A-34) | propyl methacrylate | (95) | 7500 |
| 35 | (A-35) | butyl methacrylate | (95) | 7800 |
| 36 | (A-36) | butyl methacrylate | (25) | 7300 |
| | | ethyl methacrylate | (70) | |
| 37 | (A-37) | butyl methacrylate | (65) | 7200 |
| | | cyclohexyl methacrylate | (30) | |
| 38 | (A-38) | butyl methacrylate | (87) | 6500 |
| | | 2-hydroxyethyl methacrylate | (8) | |
| 39 | (A-39) | ethyl methacrylate | (80) | 5300 |
| | | styrene | (15) | |
| 40 | (A-40) | benzyl methacrylate | (85) | 6500 |
| | | methyl acrylate | (10) | |

SYNTHESIS EXAMPLE B-1

Synthesis of Resin (B-1)

A mixed solution of 70 g of ethyl methacrylate, 30 g of macromonomer (M-1), and 150 g of toluene was heated to 70+ C. in a nitrogen stream, and 0.5 g of AIBN was added thereto to effect reaction for 4 hours. The, 0.3 g of AIBN was further added, followed by reacting for 6 hours. The resulting copolymer (B-1) had a composition (weight ratio) shown below, an Mw of $9.8\times10^4$ and a Tg of 72° C.

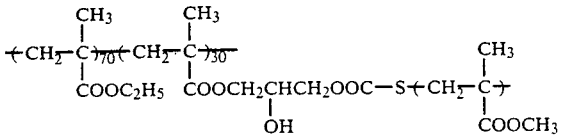

SYNTHESIS EXAMPLES B-2 TO B-15

Synthesis of Resins (B-2) to (B-15)

Resins (B) of Table 7 below were synthesized under the same polymerization conditions as in Synthesis Example B-1. The resulting resins had an Mw between $8\times10^4$ and $1.5\times10^5$.

TABLE 7

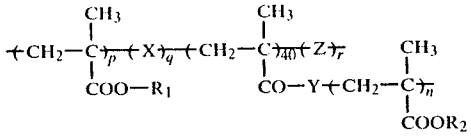

| Synthesis Example B-No. | Resin (B) | $R_1$ | p | $\leftarrow X \rightarrow$ | q | Y | $R_2$ | Z | r |
|---|---|---|---|---|---|---|---|---|---|
| 2 | [B]-2 | $-CH_3$ | 60 | — | 0 | $-OCH_2CH(OH)CH_2OOC-CH_2-S-$ | $-C_4H_9$ | — | 0 |
| 3 | [B]-3 | $-CH_3$ | 60 | — | 0 | " | $-C_3H_7$ | — | 0 |
| 4 | [B]-4 | $-C_2H_5$ | 60 | — | 0 | " | $-C_2H_5$ | — | 0 |
| 5 | [B]-5 | $-C_2H_5$ | 50 | $\leftarrow CH_2-CH(C_6H_5)\rightarrow$ | 10 | $-OCH_2CH(OH)CH_2OOC-CH_2-S-$ | $-C_2H_5$ | — | 0 |
| 6 | [B]-6 | $-CH_3$ | 50 | $\leftarrow CH_2-CH(COOCH_3)\rightarrow$ | 10 | " | " | — | 0 |
| 7 | [B]-7 | $-CH_2C_6H_5$ | 60 | — | 0 | " | " | — | 0 |
| 8 | [B]-8 | $-C_2H_5$ | 59.2 | — | 0 | " | " | $\leftarrow CH_2-CH(COOH)\rightarrow$ | 0.8 |
| 9 | [B]-9 | $-C_2H_5$ | 45 | $\leftarrow CH_2-CH(CN)\rightarrow$ | 15 | $-OCH_2CH_2-S-$ | " | — | 0 |
| 10 | [B]-10 | $-CH_3$ | 49.5 | $\leftarrow CH_2-CH(C_6H_5)\rightarrow$ | 10 | $-NHCH_2CH_2-S-$ | $-C_4H_9$ | $\leftarrow CH_2-C(CH_3)(COOH)\rightarrow$ | 0.5 |
| 11 | [B]-11 | $-C_2H_5$ | 57 | — | 0 | $-OCH_2CH(OH)CH_2OOC-CH_2CH_2-C(CH_3)(CN)-$ | $-CH_2C_6H_5$ | $\leftarrow CH_2-C(CH_3)(COOCH_2CH_2OH)\rightarrow$ | 3 |

TABLE 7-continued
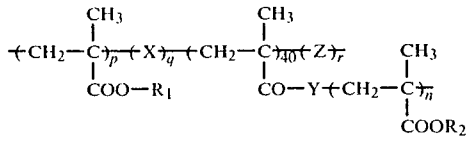
| Synthesis Example B-No. | Resin (B) | $R_1$ | p | X | q | Y | $R_2$ | Z | r |
|---|---|---|---|---|---|---|---|---|---|
| 12 | [B]-12 | $-C_3H_7$ | 45 | 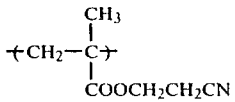 | 15 | " | $-C_2H_5$ | — | 0 |
| 13 | [B]-13 | $-C_2H_5$ | 40 | 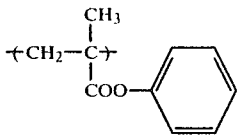 | 15 | 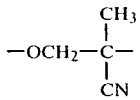 | $-C_3H_7$ | 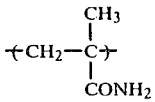 | 5 |
| 14 | [B]-14 | $-CH_3$ | 49.5 | 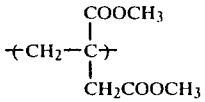 | 10 | 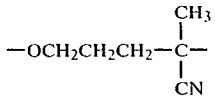 | $-C_4H_9$ | 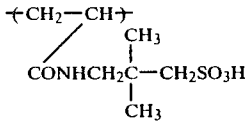 | 0.5 |
| 15 | [B]-15 | $-C_3H_7$ | 50 | 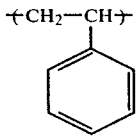 | 10 | 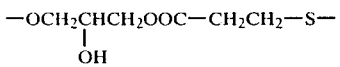 | 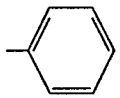 | — | 0 |

SYNTHESIS EXAMPLE B-16

Synthesis of Resin (B-16)

A mixed solution of 70 g of ethyl methacrylate, 30 g of macromonomer (M-2), 150 g of toluene, and 50 g of isopropanol was heated to 70° C. in a nitrogen stream, and 0.8 g of 4,4'-azobis(4-cyanovaleric acid) was added thereto to effect reaction for 10 hours. The resulting copolymer (B-16) had a composition shown below, an Mw of $9.8\times10^4$, and a Tg of 72° C.

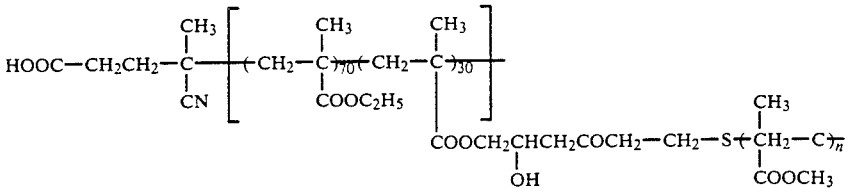

SYNTHESIS EXAMPLES B-17 TO B-24

Synthesis of Resins (B-17) to (B-24)

Resins (B) were synthesized in the same manner as in Synthesis Example B-16, except for replacing macromonomer (M-2) with each of the macromonomers shown in Table 8. The resulting resins had an Mw of from $9\times10^4$ to $1.2\times10^5$.

TABLE 8

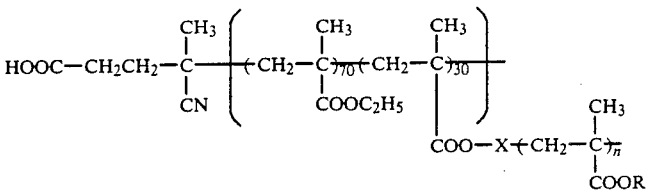

| Synthesis Example B-No. | Resin (B) | Macro-monomer | —X— | —R |
|---|---|---|---|---|
| 17 | [B]-17 | M-3 | $-CH_2CH_2-S-$ | $-C_4H_9$ |
| 18 | [B]-18 | M-4 | $-CH_2CH_2CH_2C(CH_3)(CN)-$ | $-C_2H_5$ |
| 19 | [B]-19 | M-5 | $-CH_2CH_2-S-$ | $-CH_2C_6H_5$ |
| 20 | [B]-20 | M-6 | $-CH_2CH(OH)CH_2OOC-CH_2-S-$ | $-C_3H_7$ |
| 21 | [B]-21 | M-28 | $-CH_2CH(OH)CH_2OOC-CH_2-S-$ | $-C_2H_5$ |
| 22 | [B]-22 | M-29 | " | $-C_4H_9$ |
| 23 | [B]-23 | M-30 | $-CH_2CH(OH)CH_2OOC-CH_2-S-$ | $-CH_2C_6H_5$ |
| 24 | [B]-24 | M-32 | $-CH_2CH(OH)CH_2OOC-CH_2-S-$ | $-C_6H_5$ |

SYNTHESIS EXAMPLE B-25 TO B-31

Synthesis of Resins (B-25) to (B-31)

Resins (B) were synthesized in the same manner as in Synthesis Example B-16, except for replacing ACV with each of the azobis compounds shown in Table 9 below.

TABLE 9

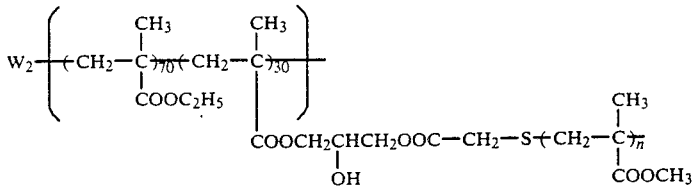

| Synthesis Example No. | Resin (B) | Azobis Compound | $W_2$ | Mw |
|---|---|---|---|---|
| 25 | (B-25) | 2,2'-azobis(2-cyanopropanol) | $HOCH_2-C(CH_3)(CN)-$ | $10.5 \times 10^4$ |
| 26 | (B-26) | 2,2'-azobis(4-cyanoheptanol) | $HOCH_2CH_2CH_2C(CH_3)(CN)-$ | $10 \times 10^4$ |
| 27 | (B-27) | 2,2'-azobis[2-methyl-N-[1,1-bis-(hydroxymethyl)-2-hydroxymethyl]-propionamide | $HOH_2C-C(CH_2OH)_2-NHCO-C(CH_3)_2-$ | $9 \times 10^4$ |
| 28 | (B-28) | 2,2'-azobis[2-methyl-N-(2-hydroxy-ethyl)propionamide | $HOCH_2CH_2-NHCO-C(CH_3)_2-$ | $9.5 \times 10^4$ |
| 29 | (B-29) | 2,2'-azobis[2-methyl-N-[1,1-bis-(hydroxymethyl)ethyl]propion-amide | $CH_3-C(CH_2OH)_2-NHCO-C(CH_3)_2-$ | $8.5 \times 10^4$ |
| 30 | (B-30) | 2,2'-azobis[2-(5-hydroxy-3,4,5,6-tetrahydropyrimidin-2-yl]propane | 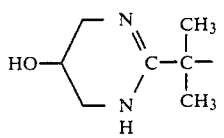 | $8.0 \times 10^4$ |
| 31 | (B-31) | 2,2'-azobis[2-[1-(2-hydroxyethyl)-2-imidazolin-2-yl]-propane | 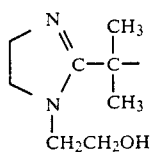 | $7.5 \times 10^4$ |

SYNTHESIS EXAMPLE B-32

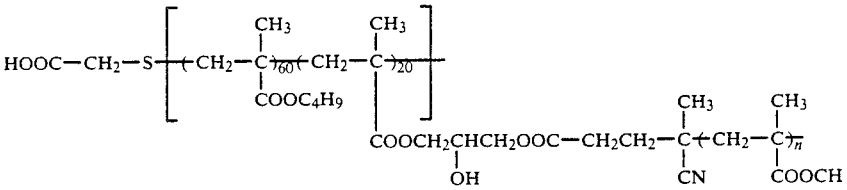

Synthesis of Resin (B-32)

A mixed solution of 80 g of butyl methacrylate, 20 g of macromonomer (M-8), 1.0 g of thioglycolic acid, 100 g of toluene, and 50 g of isopropanol was heated to 80° C. in a nitrogen stream, and 0.5 g of ACHN was added thereto, followed by stirring for 4 hours. Then, 0.3 g of ACHN was added thereto, followed by stirring for 4 hours. The resulting polymer (B-32) had a composition shown below, an Mw of $8.0 \times 10^4$ and a Tg of 41° C.

SYNTHESIS EXAMPLES B-33 TO B-29

Synthesis of Resins (B-33) to (B-39)

Resins (B) were synthesized in the same manner as in Synthesis Example B-32, except for replacing thioglycolic acid with each of the compounds shown in Table 10 below.

TABLE 10

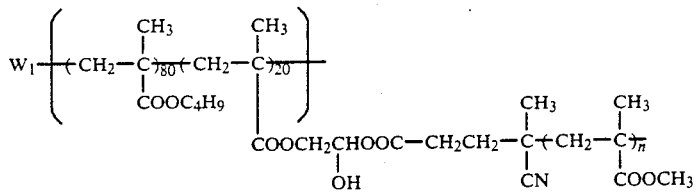

| Synthesis Example B-No. | Resin (B) | Mercaptan Compound | $W_1$ | Mw |
|---|---|---|---|---|
| 33 | (B-33) | 3-mercaptopropionic acid | $HOOC-CH_2CH_2-S-$ | $8.5 \times 10^4$ |
| 34 | (B-34) | 2-mercaptosuccinic acid | 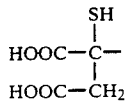 | $10 \times 10^4$ |
| 35 | (B-35) | thiosalicyclic acid | 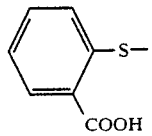 | $9 \times 10^4$ |
| 36 | (B-36) | 2-mercaptoethanesulfonic acid pyridine salt | 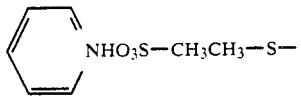 | $8 \times 10^4$ |
| 37 | (B-37) | $HSCH_2CH_2CONHCH_2COOH$ | $HOOCH_2CNHCOCH_2CH_2-S-$ | $9.5 \times 10^4$ |
| 38 | (B-38) | 2-mercaptoethanol | $HO-CH_2CH_2-S-$ | $9 \times 10^4$ |
| 39 | (B-39) | $HSCH_2CH_2COOCH_2CH_2-O-P(=O)(OH)-OH$ | $HO-P(=O)(OH)-OCH_2CH_2COCCH_2CH_2-S-$ | $10.5 \times 10^4$ |

SYNTHESIS EXAMPLES B-40 TO B-48

Synthesis of Resins (B-40) to (B-48)

Resins (B) of Table 11 were synthesized in the same manner as in Synthesis Example B-26. These resins had an Mw of from $9.5 \times 10^4$ to $1.2 \times 10^5$.

TABLE 11

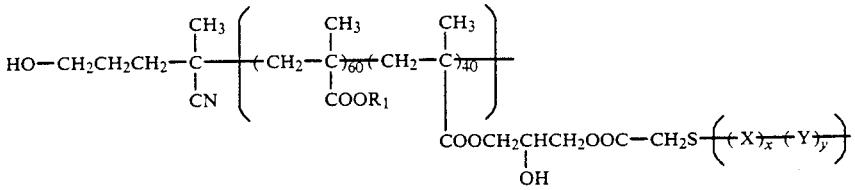

| Synthesis Example B-No. | Resin (B) | $R_1$ | X | x | Y | y |
|---|---|---|---|---|---|---|
| 40 | (B-40) | $-C_2H_5$ | 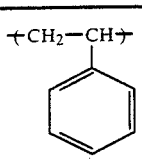 | 20 | 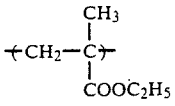 | 80 |

TABLE 11-continued
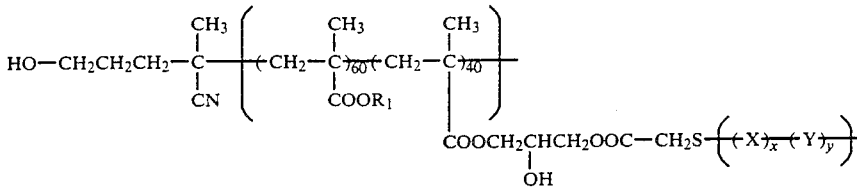
| Synthesis Example B-No. | Resin (B) | $R_1$ | X | x | Y | y |
|---|---|---|---|---|---|---|
| 41 | (B-41) | $-C_2H_5$ | 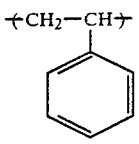 | 40 | 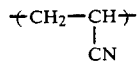 | 60 |
| 42 | (B-42) | $-C_2H_5$ | 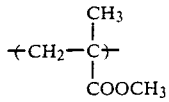 | 90 | 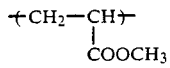 | 10 |
| 43 | (B-43) | $-C_3H_7$ | 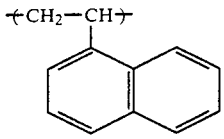 | 100 | — | 0 |
| 44 | (B-44) | $-C_3H_7$ | 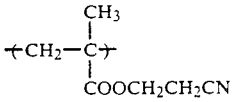 | 50 | 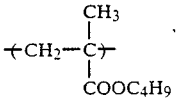 | 50 |
| 45 | (B-45) | $-C_2H_5$ | 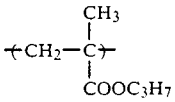 | 85 | 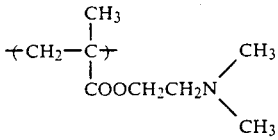 | 75 |
| 46 | (B-46) | $-C_2H_5$ | 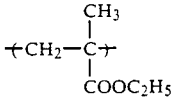 | 90 | 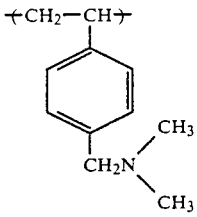 | 10 |
| 47 | (B-47) | $-C_3H_7$ | 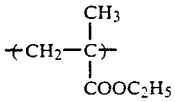 | 90 | 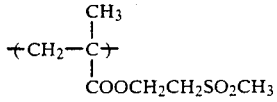 | 10 |
| 48 | (B-48) | $-C_2H_5$ | 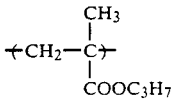 | 75 | 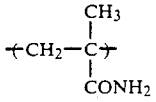 | 15 |
SYNTHESIS EXAMPLES B-49 TO B-56
Synthesis of Resins (B-49) to (B-56)
Resins (B) of Table 12 were synthesized under the same polymerization conditions as in Synthesis Example 16-B. The resulting resins had an Mw of from $9.5\times10^4$ to $1.1\times10^5$.

TABLE 12

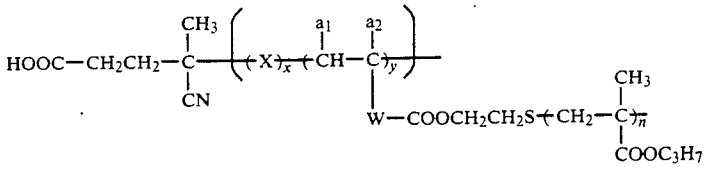

| Synthesis Example B-No. | Resin (B) | —X— | $a_1$ | $a_2$ | —W— | X/Y (weight ratio) | Macro-monomer |
|---|---|---|---|---|---|---|---|
| 49 | (B-49) | $-CH_2-C(CH_3)(COOC_2H_5)-$ | H | H | — | 90/20 | M-9 |
| 50 | (B-50) | " | $CH_3-$ | H | — | 70/30 | M-10 |
| 51 | (B-51) | $-CH_2-CH-$ (phenyl) | H | H | (phenyl) | 60/40 | M-11 |
| 52 | (B-52) | $-CH_2-C(CH_3)(COOC_2H_5)-$ | H | H | $-COOCH_2CH_2-$ | 80/20 | M-12 |
| 53 | (B-53) | $-CH_2-C(CH_3)(COOC_2H_5)-$ | H | $CH_3$ | $-COO(CH_2)_2OCO(CH_2)_2-$ | 80/20 | M-13 |
| 54 | (B-54) | $-CH_2-C(CH_3)(COOCH_2C_6H_5)-$ | H | $CH_3$ | $-CONH(CH_2)_4-$ | 80/20 | M-14 |
| 55 | (B-55) | $-CH_2-C(CH_3)(COOCH_3)-$ | H | H | $-COO(CH_2)_2OCO-$ (phenyl) | 50/50 | M-15 |
| 56 | (B-56) | $-CH_2-CH-$ (phenyl) | H | H | $-CH_2OCO(CH_2)_2-$ | 80/20 | M-17 |

SYNTHESIS EXAMPLE B-57

Synthesis of Resin (B-57)

A mixed solution of 68 g of ethyl methacrylate, 30 g of macromonomer (M-1), 2 g of acrylic acid, and 150 g of toluene was heated to 70° C. in a nitrogen stream, and 0.5 g of AIBN was added thereto to effect reaction for 10 hours. The resulting copolymer (B-57) had an Mw of $9.8\times10^4$ and a Tg of 72° C.

SYNTHESIS EXAMPLES B-58 TO B-68

Synthesis of Resins (B-58) to (B-68)

Resins (B) of Table 13 were synthesized in the same manner as in Synthesis Example 57.

TABLE 13

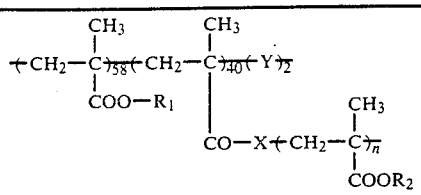

| Synthesis Example B-No. | Resin (B) | $R_1$ | X | $R_2$ | Y | Mw |
|---|---|---|---|---|---|---|
| 58 | (B-58) | $-CH_3$ | $-O-CH_2CHCH_2OOC-CH_2-S-$ | $-C_4H_9$ | — | $7.8 \times 0^4$ |
| 59 | (B-59) | $-C_2H_5$ | " | $-C_2H_5$ | — | $8.5 \times 10^4$ |
| 60 | (B-60) | " | " | " | $(CH_2-C(CH_3)(COOH))$ | $15 \times 10^4$ |
| 61 | (B-61) | $-CH_2C_6H_5$ | $-O-CH_2CHCH_2OOC-CH_2-S-$ | $-CH_3$ | $(CH_2-CH(COO(CH_2)_2COOH))$ | $18 \times 10^4$ |
| 62 | (B-62) | $-C_2H_5$ | $-OCH_2CH_2-S-$ | $-C_2H_5$ | $(CH_2-CH(COOH))$ | $9.5 \times 10^4$ |
| 63 | (B-63) | $-C_4H_9$ | $-NHCH_2CH_2-S-$ | $-C_2H_5$ | — | $6.5 \times 0^4$ |
| 64 | (B-64) | $-C_3H_7$ | $-O-CH_2CH(OH)CH_2OOCCH_2-S-$ | $-C_2H_5$ | $(CH_2-C(CH_3)(COOCH_2CH_2OH))$ | $10 \times 10^4$ |
| 65 | (B-65) | $-C_3H_7$ | $-OCH_2CH(OH)CH_2OOC-(CH_2)_2-C(CH_3)(CN)-$ | $-C_3H_7$ | $-C_3H_7(CH_2-CH(COOH))$ | $8.5 \times 10^4$ |
| 66 | (B-66) | $-C_2H_5$ | $-OCH_2-C(CH_3)(CN)-$ | $-C_3H_7$ | | $1.8 \times 10^4$ |
| 67 | (B-67) | $-C_4H_9$ | $-OCH_2CH(OH)CH_2OOC-CH_2S-$ | 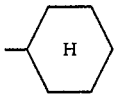 | $(CH_2-C(CH_3)(COO(CH_2)_4SO_5H))$ | $5.5 \times 10^4$ |
| 68 | (B-68) | $-C_2H_5$ | " | $-CH_2C_6H_5$ | 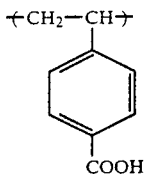 | $6.0 \times 10^4$ |

SYNTHESIS EXAMPLE B-69

Synthesis of Resin (B-69)

A mixed solution of 70 g of ethyl methacrylate, 30 g of macromonomer (M-2), 150 g of toluene, and 50 g of isopropanol was heated to 70° C in a nitrogen stream, and 1.0 g of 4,4'-azobis(4-cyanovaleric acid) was added thereto to effect reaction for 10 hours. The resulting copolymer (B-69) had a composition shown below, an Mw of $9.8 \times 10^4$, and a Tg of 72° C.

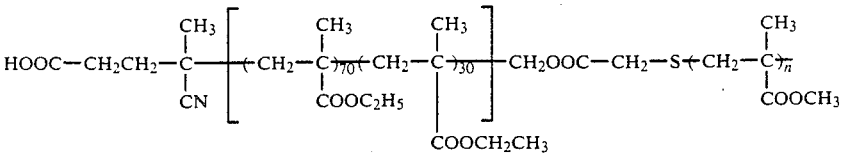

SYNTHESIS EXAMPLES B-70 TO B-77

Synthesis Examples (B-70) to (B-77)

Resins (B) of Table 14 were synthesized in the same manner as in Synthesis Example 69, except for replacing macromonomer (M-2) with each of the macromonomers shown in Table 14.

TABLE 14

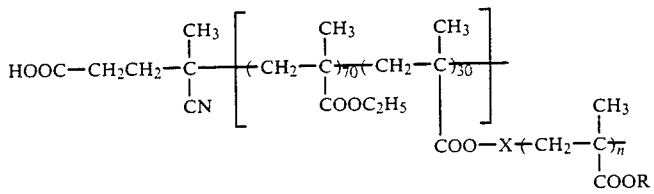

| Synthesis Example No. | Resin (B) | Macro-monomer | —X— | —R | MN |
|---|---|---|---|---|---|
| 70 | (B-70) | (M-3) | $-CH_2CH_2-S-$ | $-C_4H_9$ | $10.5 \times 10^4$ |
| 71 | (B-71) | (M-4) | $-CH_2CH_2CH_2-C(CH_3)(CN)-$ | $-C_2H_5$ | $11.0 \times 10^4$ |
| 72 | (B-72) | (M-5) | $-CH_2CH_2-S-$ | $-CH_2C_6H_5$ | $9.8 \times 10^4$ |
| 73 | (B-73) | (M-6) | $-CH_2CH(OH)CH_2OOC-CH_2-S-$ | $-C_3H_7$ | $10.0 \times 10^4$ |
| 74 | (B-74) | (M-28) | $-CH_2CH(OH)CH_2OOC-CH_2-S-$ | $-C_2H_5$ | $12.0 \times 10^4$ |
| 75 | (B-85) | (M-29) | " | $-C_4H_9$ | $9.8 \times 10^4$ |
| 76 | (B-76) | (M-30) | " | $-CH_2C_6H_5$ | $10.5 \times 10^4$ |
| 77 | (B-77) | (M-32) | " | $-C_6H_5$ | $11.0 \times 10^4$ |

SYNTHESIS EXAMPLE B-78

Synthesis of Resin (B-78)

A mixed solution of 80 g of butyl methacrylate, 20 g of macromonomer (M-8), 1.0 g of thioglycolic acid, 100 g of toluene, and 50 g of isopropanol was heated to 80° C. in a nitrogen stream, and 0.5 g of 1,1'-azobis-(cyclohexane-1-carbonitrile) (hereinafter abbreviated as ACHN) was added thereto, followed by stirring for 4 hours. Then, 0.3 g of ACHN was further added thereto, followed by stirring for 4 hours. The resulting polymer had a composition shown below, an Mw of $8.0 \times 10^4$, and a Tg of 46° C.

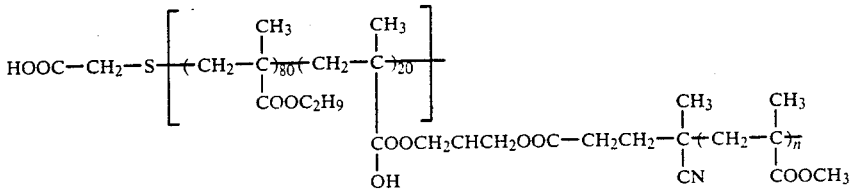

SYNTHESIS EXAMPLES B-79 TO B-85

Synthesis of Resins (B-79) to (B-85)

Resins (B) of Table 15 were synthesized in the same manner as in Synthesis Example 78, except for replacing thioglycolic acid with each of the compounds of Table 15.

TABLE 15

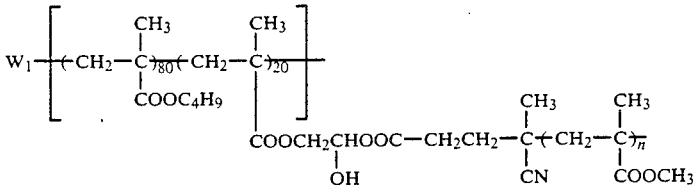

| Synthesis Example No. | Resin (B) | Mercaptan Compound | $W_1$ | Mw |
|---|---|---|---|---|
| 79 | (B-79) | 3-mercaptopropionic acid | $HOOC-CH_2CH_2-S-$ | $8.5 \times 10^4$ |
| 80 | (B-80) | 2-mercaptosuccinic acid | $HOOC-HC(HOOC-CH_2)-S-$ | $10 \times 10^4$ |
| 81 | (B-81) | thiosalicyclic acid | 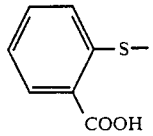 | $9 \times 10^4$ |
| 82 | (B-82) | pyridine 2-mercaptoethane-sulfonate | 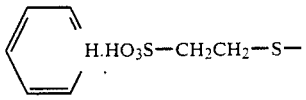 | $8 \times 10^4$ |
| 83 | (B-83) | $HSCH_2CONHCH_2COOH$ | $HOOCH_2CNHCOCH_2CH_2S-$ | $9.5 \times 10^4$ |
| 84 | (B-84) | 3-mercaptoethanol | $HO-CH_2CH_2-S-$ | $9 \times 10^4$ |
| 85 | (B-85) | $HSCH_2CH_2COOCH_2CH_2-O-P(=O)(OH)-OH$ | $HO-P(=O)(OH)-OCH_2CH_2OOC-CH_2CH_2-S-$ | $10.5 \times 10^4$ |

SYNTHESIS EXAMPLES B-86 TO B-92

Synthesis of Resins (B-86) to (B-92)

Resins (B) of Table 16 were synthesized in the same manner as in Synthesis Example 69, except for replacing ACHN with each of the azobis compounds of Table 16.

TABLE 16

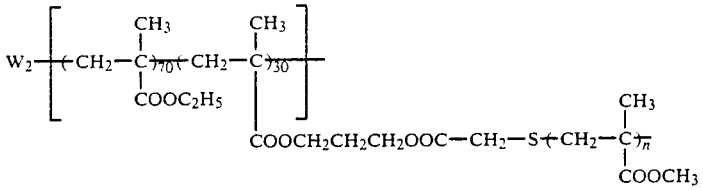

| Synthesis Example B-No. | Resin (B) | Azobis Compound | $W_2$ | Mw |
|---|---|---|---|---|
| 86 | (B-86) | 2,2'-azobis(2-cyanopropanol) | $HOCH_2-C(CH_3)(CN)-$ | $10.5 \times 10^4$ |
| 87 | (B-87) | 2,2'-azobis(4-cyanoheptanol) | $HOCH_2CH_2C(CH_3)(CN)-$ | $10 \times 10^4$ |
| 88 | (B-88) | 2,2'-azobis[2-methyl-N-[1,1-bis-(hydroxymethyl)-2-hydroxyethyl] propionamido] | $HOH_2C-C(CH_2OH)_2-NHCO-C(CH_3)_2-$ | $9 \times 10^4$ |

TABLE 16-continued

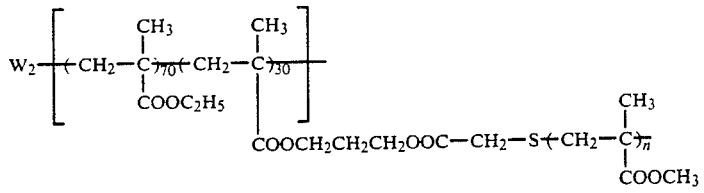

| Synthesis Example B-No. | Resin (B) | Azobis Compound | $W_2$ | Mw |
|---|---|---|---|---|
| 89 | (B-89) | 2,2'-azobis[2-methyl-N-(hydroxyethyl)propionamido] | $HOCH_2CH_2-NHCO-C(CH_3)_2-$ | $9.5 \times 10^4$ |
| 90 | (B-90) | 2,2'-azobis[2-methyl-N-[1,1-bis-(hydroxymethyl)ethyl]propionamide] | $CH_3-C(CH_2OH)_2-NHCO-C(CH_3)_2-$ | $8.5 \times 10^4$ |
| 91 | (B-91) | 2,2'-azobis[2-(5-hydroxy-3,4,5,6-tetrahydropyrimidin-2-yl)propane] | 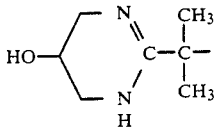 | $8.0 \times 10^4$ |
| 92 | (B-92) | 2.2'-azobis[2-[1-(2-hydroxyethyl)-2-imidazolin-2-yl]propane | 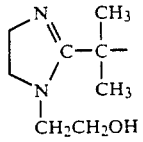 | $7.5 \times 10^4$ |

EXAMPLE 1

A mixture consisting of 6 g (solid basis) of (A-1) synthesized in Synthesis Example A-1, 34 g (solid basis) of (B-1) synthesized in Synthesis Example B-1, 200 g of zinc oxide, 0.018 g of a cyanine dye (A) shown below, 0.05 g of phthalic anhydride, and 300 g of toluene was dispersed in a ball mill for 2 hours. The resulting photoconductive composition was coated on paper having been rendered conductive with a wire bar to a dry thickness of 22 g/m2 and dried at 110° C. for 30 seconds. The coated material was allowed to stand in a dark place at 20° C. and 65% RH for 24 hours to obtain an electrophotographic photoreceptor.

Cyanine Dye (A):

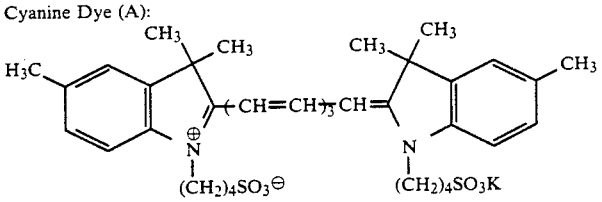

EXAMPLE 2

An electrophotographic photoreceptor was prepared in the same manner as in Example 1, except for replacing 34 g of (B-1) with 34 g (solid basis) of (B-16).

COMPARATIVE EXAMPLE A

An electrophotographic photoreceptor (designated as Sample A) was prepared in the same manner as in Example 1, except for replacing (A-1) and (B-1) with 40 g (solid basis) of (A-1) alone.

COMPARATIVE EXAMPLE B

An electrophotographic photoreceptor (designated as Sample B) was prepared in the same manner as in Example 1, except for replacing (A-1) and (B-1) with 40 g (solid basis) of a copolymer resin shown below (Mw: Tg: 40° C.)) [designated as (R-1)].

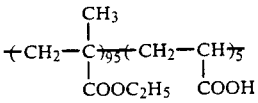

COMPARATIVE EXAMPLE C

An electrophotographic photoreceptor (designated as Sample C) was prepared in the same manner as in Example 1, except for replacing 6 g of (A-1) with 6 g of (R-1).

COMPARATIVE EXAMPLE D

An electrophotographic photoreceptor (designated as Sample D) was prepared in the same manner as in Example 1, except for replacing (A-1) and (B-1) with 40 g of a copolymer resin shown below (Mw: 45000; Tg: 46° C.) [designated as (R-2)].

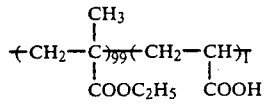

Each of the photoreceptors obtained in Examples 1 to 2 and Comparative Examples A to D was evaluated for film properties in terms of surface smoothness and mechanical strength; electrostatic characteristics; image forming performance; and stability of image forming performance against variation of environmental conditions in accordance with the following test methods. Further, an offset master plate was produced from each of the photoreceptors, and the oil-desensitivity of the photoconductive layer (in terms of contact angle with water after oil-desensitization) and printing properties (in terms of background stain resistance and printing durability) were evaluated in accordance with the following test methods. The results obtained are shown in Table 17 below.

1) Smoothness of Photoconductive Layer:

The smoothness (sec/cc) was measured by means of a Beck's smoothness tester manufactured by Kumagaya Riko K. K. under an air volume condition of 1 cc.

2) Mechanical Strength of Photoconductive Layer:

The surface of the photoreceptor was rubbed 1000 times with emery paper (#1000) under a load of 50 g/cm$^2$ by the use of a Heidon 14 Model surface tester (manufactured by Shinto Kagaku K. K.). After dusting, the abrasion loss of the photoconductive layer was measured to obtain a film retention (%).

3) Electrostatic Characteristics:

The sample was charged by corona discharge to a voltage of −6 kV for 20 seconds in a dark room at 20° C. and 65% RH using a paper analyzer ("Paper Analyzer SP-428" manufactured by Kawaguchi Denki K. K.). After the elapse of 10 seconds from the end of the corona discharge, the surface potential $V_{10}$ was measured. The standing of the sample in dark was further continued for an additional 90 seconds, and the potential $V_{100}$ was measured. The dark decay retention (DRR; %), i.e., percent retention of potential after dark decay for 90 seconds, was calculated from equation:

$$DRR(\%)=(V_{100}/V_{10})\times 100$$

Separately, the sample was charged to −400 V by corona discharge and then exposed to monochromatic light having a wavelength of 780 nm, and the time required for decay of the surface potential $V_{10}$ to one-tenth was measured to obtain an exposure $E_{1/10}$ (erg/cm$^2$).

4) Image Forming Performance:

After the samples were allowed to stand for one day at 20° C. and 65% RH (Condition I) or at 30° C. and 80% RH (Condition II), each sample was charged to −5 kV and exposed to light emitted from a gallium-aluminum arsenic semi-conductor laser (oscillation wavelength: 750 nm; output 2.8 Mw) at an exposure amount of 64 erg/cm$^2$ (on the surface of the photoconductive layer) at a pitch of 25 μm and a scanning speed of 300 m/sec. The electrostatic latent image was developed with a liquid developer ("ELP-T" produced by Fuji Photo Film Co., Ltd.), followed by fixing. The reproduced image was visually evaluated for fog and image quality.

The maximum image density ($D_m$) of a solid toner image area was measured with a Macbeth reflective densitometer.

5) Contact Angle With Water:

The sample was passed once through an etching processor using an oil-desensitizing solution ("ELP-EX" produced by Fuji Photo Film Co., Ltd.) to render the surface of the photoconductive layer oil-desensitive. On the thus oil-desensitized surface was placed a drop of 2 ul of distilled water, and the contact angle formed between the surface and water was measured by a goniometer.

6) Printing Durability:

The sample was processed in the same manner as described in 4) above, and the surface of the photoconductive layer was subjected to oil-desensitization under the same conditions as in 5) above. The resulting lithographic printing plate was mounted on an offset printing machine ("Oliver Model 52", manufactured by Sakurai Seisakusho K. K.), and printing was carried out on fine paper. The number of prints obtained until background stains on non-image areas appeared or the quality of image areas was deteriorated was taken as printing durability. The larger the number of the prints, the higher the printing durability.

TABLE 17

| | Example 1 | Example 2 | Comparative Example A | Comparative Example B | Comparative Example C | Comparative Example D |
|---|---|---|---|---|---|---|
| Surface Smoothness (sec/cc) | 90 | 89 | 92 | 88 | 90 | 35 |
| Film Strength (%) | 88 | 95 | 65 | 60 | 92 | 70 |
| $V_{10}$ (−V): | | | | | | |
| Condition I | 640 | 655 | 680 | 540 | 550 | 500 |
| Condition II | 630 | 650 | 680 | 450 | 450 | 230 |
| DRR (%): | | | | | | |
| Condition I | 82 | 85 | 88 | 81 | 80 | 45 |
| Condition II | 80 | 85 | 86 | 72 | 70 | 10 |
| $E_{1/10}$ (erg/cm$^2$) | | | | | | |
| Condition I | 26 | 25 | 23 | 46 | 45 | 88 |
| Condition II | 24 | 24 | 23 | 33 | 30 | — |
| Image Forming Performance: | | | | | | |
| Condition I | good | good | good | good | good | poor ($D_m$ was unmeasurable) |
| Condition II | good | good | good | no good (indistinct | no good (indistinct | very poor (cut of thin lines |

TABLE 17-continued

| | Example 1 | Example 2 | Comparative Example A | Comparative Example B | Comparative Example C | Comparative Example D |
|---|---|---|---|---|---|---|
| | | | | thin lines) | thin lines) | and letters, $D_m$ was unmeasurable |
| Water Contact Angle (°C.) | 11 | 12 | 10 | 10 | 11 | 25–30 |
| Printing Durability | 8000 | 10000 or more | 3000 | 3000 | 10000 or more | (widely scattered) background stains were observed from the start of printing |

As can be seen from Table 17, only Sample D using the conventionally known resin binder suffered serious deterioration of surface smoothness and electrostatic characteristics. Samples B and C, though satisfactory in film properties, suffered deterioration of electrostatic characteristics, particularly DRR, when processed under a high temperature and high humidity condition (30° C., 80% RH), which resulted in reduced image forming performance on scanning light exposure.

Sample A, unlike Samples B and C, underwent almost no change of electrostatic characteristics and image forming performance even with the change of environmental condition on processing, while exhibiting superior electrostatic characteristics under a normal temperature and normal humidity condition (20° C., 65% RH) as compared with Sample B. This is an extreme advantage when a scanning exposure system using a semi-conductor of low output is employed.

As compared with Sample A, the samples according to the present invention proved equal in electrostatic characteristics and image forming performance and superior in film strength. When they were used as an offset master plate precursor, oil-desensitization of the offset master plate precursor with an oil-desensitizing solution sufficiently proceeded to render non-image area sufficiently hydrophilic, as proved by such a small contact angle of 15° or less with water. On practical printing using the resulting master plate, no background stains were observed in the prints. To the contrary, Sample A was turned out to have poor printing durability due to its insufficient film strength.

Of the samples of Examples 1 and 2 according to the present invention, the latter, in which the resin (B) containing a polar group was used, exhibited higher film strength and thereby improved printing durability as compared with the former.

From all these considerations, the electrophotographic photoreceptors of the present invention proved satisfactory in all of surface smoothness, film strength, electrostatic characteristics, and printing suitability.

EXAMPLES 3 TO 22

An electrophotographic photoreceptor was prepared in the same manner as in Example 1, except for replacing 6 g of (A-1) with 6 g each of the resins (A) shown in Table 18, replacing 34 g of (B-1) with 34 g each of the resins (B) shown in Table 18, and replacing 0.018 g of the cyanine dye (A) with 0.018 g of a cyanine dye (B) shown below. Each of the resulting photoreceptors receptors was evaluated for film strength, electrostatic characteristics under Condition II, and printing durability in the same manner as in Example 1, and the results obtained are shown in Table 18.

Cyanine Dye (B):

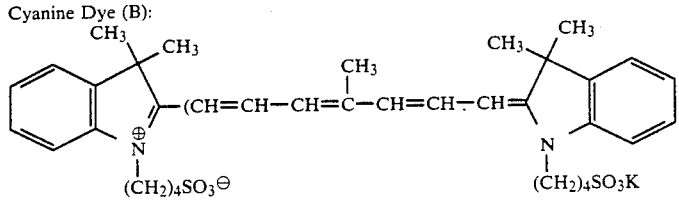

TABLE 18

| Example No. | Resin (A) | Resin (B) | Film Strength | $v_{10}$ | DRR | $E_{1/10}$ | Printing Durability |
|---|---|---|---|---|---|---|---|
| 3 | (A-2) | (B-2) | 86 | 600 | 82 | 25 | 8000 |
| 4 | (A-3) | (B-3) | 85 | 600 | 83 | 25 | 8000 |
| 5 | (A-4) | (B-4) | 88 | 550 | 80 | 27 | 8000 |
| 6 | (A-5) | (B-5) | 89 | 620 | 85 | 23 | 8300 |
| 7 | (A-6) | (B-6) | 85 | 580 | 85 | 23 | 8000 |
| 8 | (A-7) | (B-7) | 86 | 585 | 85 | 22 | 8000 |
| 9 | (A-8) | (B-8) | 90 | 560 | 84 | 24 | 10000 or more |
| 10 | (A-9) | (B-9) | 89 | 570 | 92 | 25 | 8500 |
| 11 | (A-10) | (B-10) | 88 | 550 | 80 | 26 | 10000 or more |
| 12 | (A-11) | (B-14) | 88 | 555 | 80 | 25 | 10000 or more |
| 13 | (A-13) | (B-15) | 88 | 565 | 83 | 22 | 8500 |
| 14 | (A-15) | (B-17) | 90 | 605 | 83 | 24 | 10000 or more |
| 15 | (A-17) | (B-18) | 92 | 580 | 82 | 25 | 10000 or more |
| 16 | (A-18) | (B-19) | 90 | 575 | 81 | 24 | 10000 or more |
| 17 | (A-19) | (B-25) | 90 | 590 | 82 | 25 | 10000 or more |
| 18 | (A-20) | (B-27) | 92 | 565 | 80 | 26 | 10000 or more |
| 19 | (A-21) | (B-29) | 92 | 545 | 80 | 26 | 10000 or more |
| 20 | (A-22) | (B-22) | 93 | 555 | 82 | 25 | 10000 or more |
| 21 | (A-23) | (B-35) | 94 | 600 | 83 | 22 | 10000 or more |
| 22 | (A-24) | (B-38) | 93 | 550 | 81 | 22 | 10000 or more |

EXAMPLES 23 TO 36

An electrophotographic photoreceptor was prepared in the same manner as in Example 1, except for replacing 6 g of (A-1) with 6 g each of the resins (A) shown in Table 19, replacing 34 g of (B-1) with 34 g each of the resins (B) shown in Table 19, and replacing 0.018 g of cyanine dye (A) with 0.018 g of cyanine dye (B) shown below.

Cyanine Dye (C):

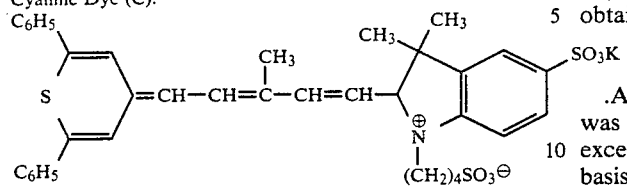

TABLE 19

| Example No. | Resin (A) | Resin (B) |
|---|---|---|
| 23 | (A-26) | (B-9) |
| 24 | (A-27) | (B-10) |
| 25 | (A-28) | (B-11 |
| 26 | (A-30) | (B-21) |
| 27 | (A-4) | (B-23) |
| 28 | (A-6) | (B-24) |
| 29 | (A-6) | (B-30) |
| 30 | (A-7) | (B-40) |
| 31 | (A-7) | (b-41) |
| 32 | (A-9) | (B-43) |
| 33 | (A-18) | (B-44) |
| 34 | (A-19) | (B-45) |
| 35 | (A-23) | (B-47) |
| 36 | (A-24) | (B-48) |

Each of the resulting photoreceptors was evaluated for various properties in the same manner as in Example 1 and, as a result, proved substantially equal to the sample of Example 1 in surface smoothness and film strength.

Accordingly, any of the electrophotographic photoreceptors of Examples 1 to 36 is excellent in charging properties, dark decay retention, and photosensitivity and provides a clear reproduced image free from background fog even when processed under severe conditions of high temperature and high humidity.

EXAMPLE 37

A mixture consisting of 5 g (solid basis) of (A-31) as synthesized in Synthesis Example A-31, 35 g (solid basis) of (B-1) as synthesized in Synthesis Example B-1, 200 g of zinc oxide, 0.018 g of the cyanine dye (A) as used in Example 1, 0.05 g of phthalic anhydride, and 300 g of toluene was dispersed in a ball mill for 2 hours. The resulting photoconductive composition was coated on paper having been rendered conductive with a wire bar to a dry thickness of 22 g/m$^2$ and heated at 110° C. for 30 seconds. Then, the resulting coated material was allowed to stand at 20° C. and 65% RH for 24 hours to obtain an electrophotographic photoreceptor.

COMPARATIVE EXAMPLE E

.An electrophotographic photoreceptor (Sample E) was prepared in the same manner as in Example 37, except for replacing (A-31) and (B-1) with 40 g (solid basis) of (A-31) alone.

COMPARATIVE EXAMPLE F

An electrophotographic photoreceptor (Sample F) was prepared in the same manner as in Example 37, except for replacing (A-31) and (B-1) with 40 g (solid basis) of (B-1) alone.

COMPARATIVE EXAMPLE G

An electrophotographic photoreceptor (Sample G) was prepared in the same manner as in Example 37, except for replacing (A-31) and (B-1) with 40 g of a copolymer resin (R-3) shown below (Mw: 35000; Tg: 46° C.). Resin (R-3):

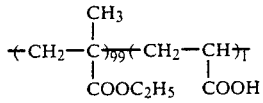

Each of the photoreceptors of Example 37 and Comparative Examples E to G was evaluated in the same manner as in Example 1 with the following exceptions. In the determination of DRR (%), potentials were measured after 10 seconds' standing ($V_{10}$) and additional 60 seconds' standing ($V_{70}$), and DRR was calculated from formula ($V_{70}/V_{10}\times 100$). In the evaluation of image forming properties, scanning light exposure was conducted by using a gallium-aluminum-arsenic semiconductor laser having an oscillation wavelength of 780 nm. The results obtained are shown in Table 20.

TABLE 20

| | Example 37 | Comparative Example E | Comparative Example F | Comparative Example G |
|---|---|---|---|---|
| Surface Smoothness (sec/cc) | 95 | 90 | 88 | 85 |
| Film strength (%) | 95 | 63 | 95 | 90 |
| $V_{10}$ (−V) | 530 | 480 | 510 | 450 |
| DRR (%) | 85 | 78 | 80 | 50 |
| $E_{1/10}$(erg/cm$^2$) | 40 | 45 | 75 | 90 |
| Image Forming Performance: | | | | |
| Condition I | good | good | no good ($D_m$ was hardly measurable; cut of thin lines was observed) | poor ($D_m$ was unmeasurable; cut of thin lines was observed) |
| Condition II | good | good | poor ($D_m$ was unmeasurable; thin lines and letters were not reproduced) | very poor ($D_m$ was unmeasurable; thin lines and letters were not reproduced) |
| Contact Angle With Water (°C.) | 14 | 13 | 16 | 18 |
| Printing Durability | 10000 or more | 3000 | cut of thin lines was observed from the start of printing | cut of thin lines was observed from the start of printing |

As can be seen from Table 20, each of the electrophotographic photoreceptors of Example 37 and Sample E was proved excellent in surface smoothness and electrostatic characteristics and provided a clear reproduced image free background fog. This is considered attributed to sufficient adsorption of the binder resin onto the photoconductive particles and sufficient covering over the surface of the photoconductive particles with the binder resin.

For the same reason, when these photoreceptors were used as an offset master plate precursor, oil-desensitization with an oil-desensitizing solution sufficiently proceeded to render non-image areas sufficiently hydrophilic, as proved by such a small contact angle of 15° or less with water. On practical printing, no background stains were observed in the prints. However, Sample E was found poor in film strength, resulting in poor printing durability on printing.

On the other hand, Samples F and G, though sufficient in film strength, suffered considerable reduction in electrostatic characteristics, particularly DRR and $E_{1/10}$ (photosensitivity), and failed to provide a satiSfactory reproduced image. Comparative Example G is an example of using a polymer having a reduced acid component content. When a high-molecular weight resin having an acid component in the same proportion as in (A-31) was used as a binder, a dispersion of zinc oxide particles formed agglomerates and a uniform dispersion could not be obtained.

From these considerations, it was proved that only the photoreceptor according to the present invention is satisfactory in all of surface smoothness, film strength, electrostatic characteristics, and printing properties.

EXAMPLES 38 TO 52

Resins (A) shown in Table 21 were synthesized under the same conditions as for (A-31).

TABLE 21

| Example No. | Resin (A) | Monomer Composition (Weight Ratio) | | | | Mw |
|---|---|---|---|---|---|---|
| 38 | (A-41) | ethyl methacrylate | 94 | itaconic acid | 6 | $7.9 \times 10^3$ |
| 39 | (A-42) | ethyl methacrylate | 95 | $CH_2{=}CH(COO(CH_2)_2COOH)$ | 5 | $7.7 \times 10^3$ |
| 40 | (A-43) | ethyl methacrylate | 92 | $CH_2{=}C(CH_3)(COO(CH_2)_2COO(CH_2)_3COOH)$ | 8 | $7.6 \times 10^3$ |
| 41 | (A-44) | ethyl methacrylate | 92 | $CH_2{=}C(CH_3)(CONH(CH_2)_{10}COOH)$ | 8 | $7.8 \times 10^3$ |
| 42 | (A-45) | ethyl methacrylate | 95 | $CH_2{=}C(CH_2COOCH_3)(COOH)$ | 5 | $8.0 \times 10^3$ |
| 43 | (A-46) | ethyl methacrylate | 95 | 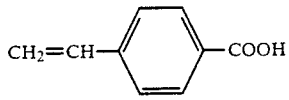 | 5 | $8.2 \times 10^3$ |
| 44 | (A-47) | ethyl methacrylate | 95 | 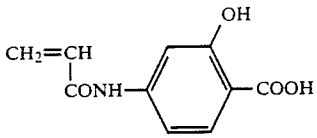 | 5 | $8.0 \times 10^3$ |
| 45 | (A-48) | ethyl methacrylate | 98 | $CH_2{=}C(CH_3)(COO(CH_2)_3SO_3Na)$ | 2 | $7.6 \times 10^3$ |
| 46 | (A-49) | ethyl methacrylate | 99 | $CH_2{=}C(CH_3)(COO(CH_2)_2O{-}P(=O)(OH)OH)$ | 1 | $8.0 \times 10^3$ |
| 47 | (A-50) | butyl methacrylate | 98 | 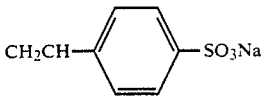 | 2 | $6.5 \times 10^3$ |
| 48 | (A-51) | butyl methacrylate | 95 | $CH_2{=}CH{-}CH_2(OCO(CH_2)_2COOH)$ | 5 | $8.3 \times 10^3$ |

TABLE 21-continued

| Example No. | Resin (A) | Monomer Composition (Weight Ratio) | | | Mw |
|---|---|---|---|---|---|
| 49 | (A-52) | benzyl methacrylate | 99 | 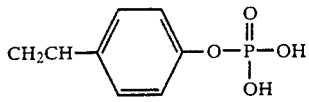 | 1 |
| 50 | (A-53) | butyl methacrylate | 98 | 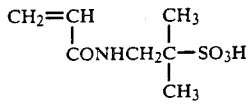 | 2 $5.6 \times 10^3$ |
| 51 | (A-54) | butyl methacrylate | 95 | 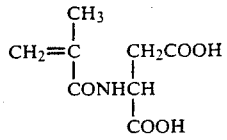 | 5 $6.8 \times 10^3$ |
| 52 | (A-55) | butyl methacrylate | 95 | 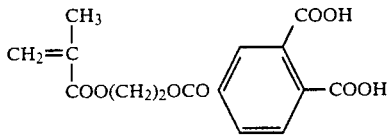 | 1 $7.3 \times 10^3$ |

An electrophotographic photoreceptor was prepared in the same manner as in Example 37, except for using 10 g (solid basis) of each of the resins (A) of Table 21 and 30 g (solid basis) of (B-1) and evaluated for various characteristics in the same manner as in Example 37. As a result, each of the photoreceptors revealed substantial equality to the same of Example 37 in terms of surface smoothness and film strength.

Accordingly, it was thus proved that any of the photoreceptors according to the present invention is excellent in charging properties, dark decay retention, and photosensitivity and provides a clear reproduced image free from background fog even when processed under severe conditions of high temperature and high humidity (30° C., 80% RH).

EXAMPLES 53 TO 64

An electrophotographic photoreceptor was prepared in the same manner as in Example 37, except for using (A-31) and each of the resins (B) shown in Table 22 at a weight ratio of ¼ as a resin binder. Surface smoothness, film strength, and electrostatic characteristics of each of the resulting photoreceptors were evaluated in the same manner as in Example 37. As a result, any of the photoreceptors was proved to be satisfactory in film strength and electrostatic characteristics and to provide a clear reproduced image free from background fog even when processed under a high temperature and high humidity condition (30° C., 80% RH).

TABLE 22

| Example No. | Resin (B) | Example No. | Resin (B) |
|---|---|---|---|
| 53 | (B-2) | 59 | (B-12) |
| 54 | (B-3) | 60 | (B-14) |
| 55 | (B-4) | 61 | (B-17) |
| 56 | (B-5) | 62 | (B-20) |
| 57 | (B-9) | 63 | (B-22) |
| 58 | (B-10) | 64 | (B-24) |

EXAMPLES 64 TO 74

An electrophotographic photoreceptor was prepared in the same manner as in Example 37, except for using each of the resins (A) shown in Table 23 and each of the resins (B) shown in Table 23 at a weight ratio of 1/5.6 as a binder resin. Surface smoothness, film strength, and electrostatic characteristics of the resulting photoreceptors were evaluated in the same manner as in Example 37. As a result, each of the photoreceptors was proved to be satisfactory in film strength and electrostatic characteristics and to provide a clear reproduced image free from background fog even when processed under a high temperature and high humidity condition (30° C., 80% RH).

TABLE 23

| Example No. | Resin (A) | Resin (B) |
|---|---|---|
| 65 | (A-31) | (B-6) |
| 66 | (A-33) | (B-7) |
| 67 | (A-34) | (B-8) |
| 68 | (A-32) | (B-10) |
| 69 | (A-40) | (B-11) |
| 70 | (A-33) | (B-13) |
| 71 | (A-35) | (B-15) |
| 72 | (A-36) | (B-16) |
| 73 | (A-39) | (B-19) |
| 74 | (A-31) | (B-23) |

EXAMPLE 75

A mixture consisting of 8 g (solid basis) of (A-1), 32 g (solid basis) of (B-57), 200 g of zinc oxide, 0.018 g of the cyanine dye A as used in Example 1, 0.10 g of phthalic anhydride, and 300 g of toluene was dispersed in a ball mill for 2 hours. The resulting photoconductive composition was coated on paper having been rendered conductive with a wire bar to a dry thickness of 18 g/cm$^2$ and dried at 110° C. for 30 seconds. The coated material was allowed to stand in a dark place at 20° C. and 65% RH for 24 hours to obtain an electrophotographic photoreceptor.

COMPARATIVE EXAMPLE H

An electrophotographic photoreceptor (designated as Sample H) was prepared in the same manner as in Example 75, except for replacing (A-1) and (B-57) as used in Example 75 with 40 g (solid basis) of (A-1) alone.

COMPARATIVE EXAMPLE I

An electrophotographic photoreceptor (Sample I) was prepared in the same manner as in Example 75, except for replacing (A-1) and (B-57) with 40 g (solid basis) of (B-57) alone.

COMPARATIVE EXAMPLE J

An electrophotographic photoreceptor (Sample J) was prepared in the same manner as in Example 75, except for replacing (A-1) and (B-57) with 40 g of a copolymer resin (R-4) shown below (Mw: 35000; Tg: 46° C.). Resin (R-4):

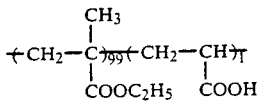

Each of the photoreceptors obtained in Example 75 and Comparative Examples H to J was evaluated for film properties (surface smoothness), film strength, electrostatic characteristics, image forming performance, contact angle with water, and printing durability in the same manner as in Example 37. The results obtained are shown in Table 24.

TABLE 24

| | Example 75 | Comparative Example H | Comparative Example I | Comparative Example J |
|---|---|---|---|---|
| Surface Smoothness (sec/cc) | 95 | 90 | 80 | 85 |
| Film strength (%) | 95 | 63 | 96 | 90 |
| $V_{10}$ (−V) | 465 | 460 | 120 | 450 |
| DRR (%) | 80 | 78 | 15 | 50 |
| $E_{1/10}$(erg/cm$^2$) | 45 | 44 | 75 | 90 |
| Image Forming Performance: | | | | |
| Condition I | good | good | poor (no $D_m$ was measured; cut of fine lines) | poor (no $D_m$ was measured; cut of fine lines) |
| Condition II | good | good | very poor (no $D_m$ measured; thin lines and letters were not reproduced) | very poor (no $D_m$ measured; thin lines and letters were not reproduced) |
| Contact Angle With Water (°C.) | 16 | 13 | 18 | 18 |
| Printing Durability | 10000 or more | 3000 | cut of thin lines was observed form the start of printing | cut of thin lines was observed from the start of printing |

As is shown in Table 24, the Sample of Example 64 and Sample H both had satisfactory surface smoothness and satisfactory electrostatic characteristics and provided a clear reproduced image free from background fog. This is believed attributed to sufficient adsorption of the binder resin onto the photoconductive substance and sufficient covering of the photoconductive particles with the binder resin.

For the same reasons, when they were used as an offset master plate precursor, oil-desensitization with an oil-desensitizing solution sufficiently proceeded to make non-image areas sufficiently hydrophilic as proved by a small contact angle with water of 15° C. or less. On practical printing, no background stain was observed on the prints. Sample H, however, was turned out to exhibit poor printing durability due to its insufficient film strength.

Samples I and J, though sufficient in film strength, suffered significant reduction of electrostatic characteristics, particularly DRR and $E_{1/10}$ (photosensitivity) so that they failed to provide a satisfactory reproduced image on electrophotographic processing. Comparative Example J is an example of using a polymer having a reduced content of an acidic component. When a high-molecular weight polymer having an acidic component in the same proportion as in the resin of Example 75 was employed, the dispersion of zinc oxide formed agglomerates, resulting in the failure of preparing a coating composition for a photoconductive layer.

From all these considerations, it can thus be proved that only the photoreceptor according to the present invention satisfies all the requirements of surface smoothness, film strength, electrostatic characteristics, and printing properties.

EXAMPLES 76 TO 90

An electrophotographic photoreceptor was prepared in the same manner as in Example 75, except for using 10 g (solid basis) of each of (A-41) to (A-55) of Table 21 and 30 g (solid basis) of (B-57) as synthesized in Synthesis Example B-57. Each of the resulting photoreceptors was evaluated in the same manner as in Example 75 and, as a result, revealed substantial equality to the sample of Example 75 in terms of surface smoothness and film strength.

Each of the photoreceptors according to the present invention was proved to be excellent in charging properties, dark decay retention and photosensitivity and to provide a clear reproduced image free from background fog even when processed under severe conditions of high temperature and high humidity (30° C., 80% RH).

EXAMPLES 91 TO 101

An electrophotographic photoreceptor was prepared in the same manner as in Example 75, except for using (A-1) and each of the resins (B) shown in Table 25 at a weight ratio of ¼ as a binder resin.

TABLE 25

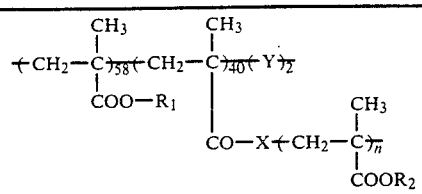

| Example No. | Resin (B) | $R_1$ | X | $R_2$ | Y | Mw |
|---|---|---|---|---|---|---|
| 91 | (B-2) | $-CH_3$ | $-O-CH_2CH(OH)CH_2OOC-CH_2-S-$ | $-C_4H_9$ | — | $7.8 \times 10^4$ |
| 92 | (B-3) | $-C_2H_5$ | " | $-C_2H_5$ | — | $8.5 \times 10^4$ |
| 93 | (B-4) | " | " | " | $\leftarrow CH_2-C(CH_3)(COOH)\rightarrow$ | $15 \times 10^4$ |
| 94 | (B-5) | $-CH_2C_6H_5$ | " | $-CH_3$ | $\leftarrow CH_2-CH(COO(CH_2)_2COOH)\rightarrow$ | $18 \times 10^4$ |
| 95 | (B-6) | $-C_2H_5$ | $-OCH_2CH_2-S-$ | $-C_2H_5$ | $\leftarrow CH_2-CH(COOH)\rightarrow$ | $9.5 \times 10^4$ |
| 96 | (B-7) | $-C_4H_9$ | $-NHCH_2CH_2-S-$ | $-C_2H_5$ | — | $6.5 \times 0^4$ |
| 97 | (B-8) | $-C_3H_7$ | $-O-CH_2CH(OH)CH_2OOCCH_2-S-$ | $-C_2H_5$ | $\leftarrow CH_2-C(CH_3)(COOCH_2CH_2OH)\rightarrow$ | $10 \times 10^4$ |
| 98 | (B-9) | $-C_2H_5$ | $-OCH_2CH(OH)CH_2OOC(CH_2)_2-C(CH_3)(CN)-$ | $-C_3H_7$ | $\leftarrow CH_2-CH(COOH)\rightarrow$ | $8.5 \times 10^4$ |
| 99 | (B-10) | $-C_2H_5$ | $-OCH_2-C(CH_3)(CN)-$ | $-C_3H_7$ | — | $1.8 \times 10^4$ |
| 100 | (B-11) | $-C_4H_9$ | $-OCH_2CH(OH)CH_2OOC-CH_2S-$ | 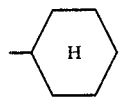 | $\leftarrow CH_2-C(CH_3)(COO(CH_2)_4SO_5H)\rightarrow$ | $5.5 \times 10^4$ |
| 101 | (B-12) | $-C_2H_5$ | " | $-CH_2C_6H_5$ | 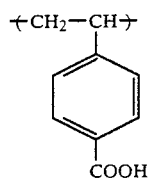 | $6.0 \times 10^4$ |

Each of the resulting photoreceptors was evaluated for surface smoothness, film strength, and electrostatic characteristics in the same manner as in Example 75. As a result, any of the photoreceptors according to the present invention was proved to be satisfactory in film strength and electrostatic characteristics and to provide a clear reproduced image free from background fog even when processed under a high temperature and high humidity condition (30° C., 80% RH).

EXAMPLES 102 TO 110

An electrophotographic photoreceptor was prepared in the same manner as in Example 75, except for replacing 8 g of (A-1) as used in Example 75 with 8 g of each of (A-32) to (A-40) as synthesized in Synthesis Examples A-32 to A-40. The results of evaluations of the photoreceptors were similar to those obtained in Example 75.

EXAMPLES 111 TO 136

Resins (B-58) to (B-83) were synthesized in the same manner as in Synthesis Example 57, except for replacing 30 g of macromonomer (M-1) with 30 g each of the macromonomers (M-2) to (M-27) as obtained in Synthesis Examples M-2 to M-27.

An electrophotographic photoreceptor was prepared in the same manner as in Example 75, except for replacing 32 g of (B-57) as used in Example 75 with 32 g each of these resins (B). The results of evaluations of the photoreceptors were similar to those obtained in Example 75.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having provided thereon a photoconductive layer containing at least an inorganic photoconductive material and a binder resin, wherein said binder resin comprises (A) at least one resin having a weight average molecular weight of from b $1\times10^3$ to $2\times10^4$ and containing from 0.1 to 20% by weight of a copolymerizable component containing at least one acidic group selected from the group consisting of $-PO_3H_2$, $-COOH$, $-SO_3H$,

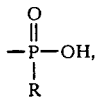

wherein R represents a hydrocarbon group or —OR'; and R' represents a hydrocarbon group, and a cyclic acid anhydride-containing group, and (B) at least one copolymer resin comprising a monofunctional macromonomer having a weight average molecular weight of $2\times10^4$ or less, said macromonomers containing at least one polymerizable component represented by formula (B-2) or (B-3):

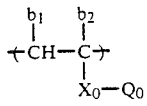

(B-2)

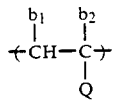

(B-3)

wherein $X_0$ represents —COO—, —OCO—, —$CH_2$OCO—, —$CH_2$COO—, —O—, —$SO_2$—, —CO—,

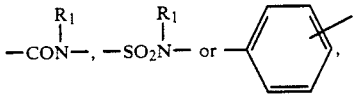

wherein $R_1$ represents a hydrogen atom or a hydrocarbon group; $Q_0$ represents an aliphatic group having from 1 to 18 carbon atoms or an aromatic group having from 6 to 12 carbon atoms; $b_1$ and $b_2$, which may be the same or different, each represents a hydrogen atom, a halogen atom, a cyano atom or a substituted or unsubstituted hydrocarbon group, a hydrocarbon group, —COO—Z or —COO—Z bonded via a hydrocarbon group, wherein Z represents a hydrogen group; and Q represents

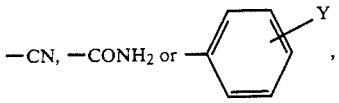

wherein Y represents a hydrogen atom, a halogen atom, an alkoxyl group or —COOZ', wherein Z' represents an alkyl group, an aralkyl group or an aryl group, with a polymerizable double bond-containing group represented by formula (B-1):

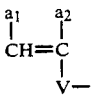

(B-1)

wherein V has the same meaning as $X_0$; and $a_1$ and $a_2$, which may be the same or different, each has the same meaning as $b_1$ and $b_2$, being bonded to only one of terminals of the main chain thereof, and a monomer represented by formula (B-4):

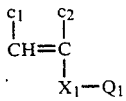

(B-4)

wherein $X_1$ has the same meaning as $X_0$; $Q_1$ has the same meaning as $Q_0$; and $c_1$ and $c_2$, which may be the same or different, each has the same meaning as $b_1$ and $b_2$.

2. An electrophotographic photoreceptor as claimed in claim 1, wherein said resin (A) is a (meth)acrylic copolymer containing 30 wt % or more of a monomer represented by formula (A-1)

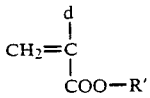

(A-1)

wherein d represents a hydrogen atom, a halogen atom, a cyano group or an alkyl group having from 1 to 4 carbon atoms; and R' represents a hydrocarbon group.

3. An electrophotographic photoreceptor as claimed in claim 1, wherein said resin (A) is a resin comprising as copolymerizable components (i) at least one repeating unit represented by formula (A 2) or (A-3):

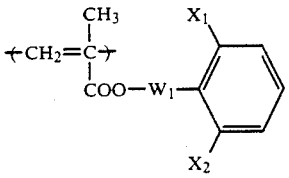

(A-2)

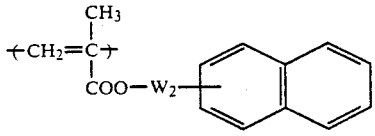

(A-3)

wherein $X_1$ and $X_2$ each represents a hydrogen atom, a hydrocarbon group having from 1 to 10 carbon atoms, a chlorine atom, a bromine atom, —$COY_1$ or $COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ and $W_2$ each represents a mere bond or a linking group containing from 1 to 4 linking atoms, which connects —COO— and the benzene ring; and (ii) from 0.5 to 20% by weight of at least one repeating unit containing at least one substituent selected from the group consisting of $—PO_3H_2$, —COOH, $—SO_3H$,

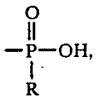

wherein R represents a hydrocarbon group or —OR'; and R' represents a hydrocarbon group, and a cyclic acid anhydride-containing group.

4. An electrophotographic photoreceptor as claimed in claim 1, wherein said copolymerizable component containing an acidic group is present in a proportion of from 1 to 10% by weight.

5. An electrophotographic photoreceptor as claimed in claim 1, wherein said resin (A) has a weight average molecular weight of from $3\times10^3$ to $1.0\times10^4$.

6. An electrophotographic photoreceptor as claimed in claim 1, wherein said resin (B) has a weight average molecular weight of $2\times10^4$ or more.

7. An electrophotographic photoreceptor as claimed in claim 1, wherein said resin (B) has a weight average molecular weight of from $5\times10^4$ to $6\times10^5$.

8. An electrophotographic photoreceptor as claimed in claim 1, wherein said resin (B) is a resin in which at least one acidic group selected from the group consisting of $—PO_3H_2$, $—SO_3H$, —COOH,

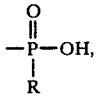

wherein R represents a hydrocarbon group or OR', wherein R' represents a hydrocarbon group, and a cyclic acid anhydride-containing group is bonded to only one terminal of the main chain of said copolymer resin.

9. An electrophotographic photoreceptor as claimed in claim 1, wherein said inorganic photoconductive material is zinc oxide, and said zinc oxide is in the form of particles.

* * * * *